US007717299B2

(12) United States Patent
Greiner-Perth

(10) Patent No.: US 7,717,299 B2
(45) Date of Patent: May 18, 2010

(54) ACTUATING DEVICE FOR A MEDIUM DISPENSER

(75) Inventor: Juergen Greiner-Perth, Gottmadingen (DE)

(73) Assignee: ING. Erich Pfeiffer GmbH, Radolfzell (DE)

( * ) Notice: Subject to any disclaimer, the term of this patent is extended or adjusted under 35 U.S.C. 154(b) by 1156 days.

(21) Appl. No.: 11/180,510

(22) Filed: Jul. 13, 2005

(65) Prior Publication Data

US 2006/0016833 A1 Jan. 26, 2006

(30) Foreign Application Priority Data

Jul. 13, 2004 (DE) ..... 10 2004 035 141

(51) Int. Cl.
*B67D 7/84* (2010.01)

(52) U.S. Cl. ..... 222/162; 222/153.11; 222/183; 128/200.14; 128/200.22; 128/205.18; 604/19; 604/290

(58) Field of Classification Search ..... 222/82, 222/95, 162, 321.9, 183, 321.7, 383.1, 153.11; 128/200.14, 200.22–200.23, 205.18; 604/19, 604/290, 294, 298

See application file for complete search history.

(56) References Cited

U.S. PATENT DOCUMENTS 4,053,086 A * 10/1977 DeBard ..... 222/182
4,771,769 A * 9/1988 Hegemann et al. ..... 128/200.22
4,787,891 A * 11/1988 Levin et al. ..... 604/136
6,308,867 B1 10/2001 Wolter
6,708,846 B1 * 3/2004 Fuchs et al. ..... 222/82
7,201,296 B2 4/2007 Graf
2004/0000567 A1 * 1/2004 Greiner-Perth ..... 222/321.1
2004/0011819 A1 * 1/2004 Jennings et al. ..... 222/162
2004/0256414 A1 12/2004 Graf

FOREIGN PATENT DOCUMENTS

DE 198 40 723 A1 3/2000
DE 102 20 557 A1 11/2003
WO WO 03/026803 A1 4/2003
WO WO 03/074189 A1 9/2003

OTHER PUBLICATIONS

European Patent Office Search Report dated Nov. 28, 2007 (7 pages).

* cited by examiner

*Primary Examiner*—Kevin P Shaver
*Assistant Examiner*—Andrew P Bainbridge
(74) *Attorney, Agent, or Firm*—Flynn, Thiel, Boutell & Tanis, P.C.

(57) ABSTRACT

An actuating device for a manually operable medium dispenser includes an energy store for storing an actuating energy necessary to actuate the medium dispenser and a control device for liberating the actuating energy. The control device is being configured for a liberation of the actuating energy when a minimum energy stored in the energy store is exceeded.

2 Claims, 20 Drawing Sheets

Detail X

ACTUATING DEVICE FOR A MEDIUM DISPENSER

FIELD OF THE INVENTION

The invention relates to an actuating device for a manually operable medium dispenser, having an energy store for storing an actuating energy necessary to actuate the medium store and having means for loading the energy store with the actuating energy in dependence on a manual movement of an actuating element.

BACKGROUND OF THE INVENTION

From the prior art, DE 102 20 557 A1 is known, which shows a manually operable medium dispenser having an actuating device. The actuating device is equipped with a slide valve, which is operated on a path-dependent basis and is activated by a relative movement between a piston rod and a control spike fitted in a pump cylinder. Since a pump chamber essentially limited by the pump cylinder and a piston packing is closed in a starting state via the path-dependent-operating slide valve, the medium enclosed in the pump chamber is pressurized upon actuation of the piston rod. Consequently, a relative movement of the piston packing relative to the piston rod takes place. As a result of the relative movement, a spring which serves as a loading means and is in operative connection with the piston packing is pretensioned, a force equilibrium existing between a tension of the spring and a pressure in the medium. As soon as the piston rod has covered a predetermined path, the slide valve opens due to the relative movement between piston rod and control spike, so that the medium pressurized by the spring can be discharged. The aim of this is to obtain a discharge of the medium which is independent of an actuating method.

SUMMARY OF THE INVENTION

The object of the invention consists in providing an actuating device of the type stated in the introduction which allows an improved, user-independent medium discharge.

This object is achieved by a control device being in operative connection with the loading means, which control device undertakes to liberate the actuating energy of the energy store once an energy level corresponding to the actuating energy is reached.

The minimum energy stored in the energy store serves to ensure that the discharge operation which is intended to be obtained with the actuating device proceeds in such a way that the at least one medium to be discharged from the medium dispenser is dosed and distributed properly and independently of operating influences. This is particularly of critical importance in respect of liquid, gel-like or cream-like, low to high viscosity media, and in respect of powdery media which can respectively be used as, for example, pharmaceutical substances. The actuating device ensures that the at least one medium stored in a medium dispenser is subjected to a sufficient actuating energy and an advantageous actuating speed in order to achieve the intended dosing and distribution or application of the medium, especially through a spraying operation into an environment. In order to ensure an advantageous discharge operation, the control device is realized such that a liberation of the actuating energy can take place provided that a minimum energy is stored in the energy store. The actuating device serves to ensure, even amongst users who have difficulties applying the actuating energy, that a regular and proper medium discharge takes place. The user can concentrate on the application of the triggering energy, while the discharge operation for the medium proceeds without any further effort on the part of the user. Even a slow or uneven or interrupted actuation creates the even and exactly dosed discharge operation. This is especially important in the design of medium dispensers and discharge devices for children, frail or elderly people. The solution according to the invention is especially suitable for pharmaceutical, but also for cosmetic media and applications.

By virtue of the invention, it is possible to ensure that the medium is only subjected to the actuating energy once the control device effects the liberation of the actuating energy. This produces especially advantageous discharge characteristics for the medium dispenser, since, at the start of the discharge operation, the maximum actuating energy is available, allowing a very spontaneous medium discharge. Through this type of arrangement, for a rest state, during the storage of the actuating energy and for the discharge operation, there is ensured a compact force flow between the energy store and those parts of the medium dispenser or discharge device which are subjected to the actuating energy, which is advantageous to their structural dimensioning. The user subjects the actuating device to a predefinable work, i.e. to a force to be applied along an actuating path. In this case, the actuating path is the path which a handle to be actuated by the user covers between a neutral position and a liberation setting for the actuating energy. The work applied by the user substantially corresponds to the actuating energy stored in the energy store. Once the structurally predefinable actuating path is reached, the actuating energy necessary to the regular and proper actuation of the medium dispenser or of the discharge device is guaranteed to be present, with the result that the liberation of the actuating energy can then take place. According to the invention, a constant dosing volume and defined dosing properties such as spray pattern, drip size and the like can be obtained independently of an actuating speed, an actuating force of the operator, as well as independently of actuating path characteristics or return stroke characteristics. As single-part or multi-part energy stores, mechanical spring stores or energy stores subjected to a pressure medium are particularly envisaged.

In one embodiment of the invention, the energy level is attainable on a path-dependent basis and corresponds to a predefined actuating position of the actuating element. Preferably, the actuating element is movable in a stroke motion, so that the determinant actuating position is a predetermined stroke position in which the control device liberates the energy store.

In a further embodiment of the invention, the control device has a positioning mechanism for transmitting an positioning movement and a trigger mechanism for activating the positioning mechanism, which mechanisms are arranged so as to be movable one relative to the other and can be brought into operative connection with each other in order to liberate the actuating energy. The positioning mechanism can be envisaged, for example, as an actuating member for a pump piston of a medium dispenser or as a receiving fixture for a medium store or a medium pump in a discharge device. The positioning mechanism is thus envisaged for a direct or indirect transfer of the actuating energy stored in the energy store to the medium to be discharged. The trigger mechanism is intended to liberate the actuating energy to be transmitted by the positioning mechanism and thus to start the discharge operation.

In a further embodiment of the invention, the positioning mechanism has latching means for positively back-gripping a holding geometry in the rest position. A locking of the positioning mechanism up to the liberation of the actuating energy can thereby be achieved in a simple manner. The holding geometry can be provided, for example, on a wall of a pump cylinder or on a receiving fixture for a medium dispenser and, in particular, as an undercut, offset or collar. In the rest position of the positioning mechanism, the latching means enter into operative connection with the holding geometry and thereby ensure a fixed positioning of the positioning mechanism. The latching means can be realized, in particular, as latching bosses or latching hooks and can be connected to the positioning mechanism at solid joints. In an advantageous embodiment of the invention, the latching means are elastically pretensioned, so that, once the rest position is reached, they engage positively in the holding geometry without any further effort.

In a further embodiment of the invention, the trigger mechanism has positively acting unlocking means for activating the latching means. An unlocking of the latching means of the positioning mechanism can hence be performed in a simple and reliable manner. At the time of liberation of the actuating energy, the latching means are subjected to considerable force. Through the use of the positively acting unlocking means, the latching means can be deflected advantageously out of the rest position.

In a further embodiment of the invention, the unlocking means are, at least in some sections, of wedge-shaped configuration. An advantageous matching of the actuating path necessary to unlock the latching means to the forces necessary to the unlocking can thereby be conducted. Such a matching is possible, in particular, via an adjustment of a wedge angle of the unlocking means.

In a further embodiment of the invention, the energy store is designed for storage of a kinetic energy by means of elastic deformation. This allows a very simple and compact design of the energy store. The actuating energy can be stored, in particular, by elastic deformation of one or more energy store sections. Preferably, the energy store is formed by one or more helical springs. Alternatively, plastics pneumatic springs, leaf springs, elastomer elements, coil springs, metallic or nonmetallic spring elements and the like can be envisaged. The energy store can also be configured as a traction element made of an elastic plastics material, especially of thermoplastic elastomer. For this, a substantially hose-shaped traction element, or a traction element consisting of a plurality of elastomer strands, which are arranged loose or mutually connected, is suitable. A realization of the energy store as a pressure store for a compressible gas, especially air, is also conceivable. A linear movement can thus easily be used to feed actuating energy into the energy store; upon the liberation of the actuating energy, just such a linear movement can be transferred by the control device, using the positioning mechanism, to a pump piston of a medium dispenser, to a medium store or to a medium pump of a discharge device. The helical spring can be realized as a linear, degressive, progressive helical spring, or as a combination thereof, to obtain an optimal adjustment of the actuating force, which is to be applied by the user, to the actuating path.

In a further embodiment of the invention, the energy level for the actuation of the medium dispenser can be substantially predefined by a distancing of the latching means from the unlocking means, and/or a spring constant of the energy store, and/or a pretensioning of the energy store in the rest position. Through a distancing of the unlocking means from the latching means, the actuating path is defined within which the user exerts the actuating force and thus feeds the corresponding actuating energy, in the form of work, into the energy store. The spring constant is determined by the elastic deformation of the energy store in dependence on the force deployed. The pretensioning of the energy store is that energy which is stored already in the rest position by elastic deformation of the energy store built up in the actuating device. By changing one or more of the aforementioned variables, it is possible constructively to influence the minimum energy which should be made available to actuate the medium dispenser.

In a further embodiment of the invention, a second, in particular single-part or multi-part, energy store is provided, which is realized as a resetting device for the first energy store. This serves to ensure that, following the medium discharge, the actuating device is returned into the rest position, so that a new actuation is enabled. The second energy store can, in particular, be connected in series to the first energy store, so that a liberation of the actuating energy stored in the first energy store leads to a storage of energy in the second energy store. The second energy store can here be realized, in particular, as a helical spring having a small spring constant than the first energy store.

Preferably, the actuating device is provided with a receiving zone for different types of medium dispensers which, in particular, have a thrust piston pump and a medium store. According to the purpose of use, the actuating device can optionally be detachably connected to a variety of medium dispensers.

The object of the invention is also achieved by a medium dispenser which has an actuating device according to the invention. Here the actuating device is preferably an integral part of the medium dispenser, especially of the medium pump designed to discharge the medium from the medium store. A particularly advantageous, user-independent actuation of the medium dispenser can thereby be achieved directly through the structural design of the medium dispenser, especially of the medium pump. Compared to the actuating devices known from the prior art, in the actuating device according to the invention a reliable distribution of the medium, especially an atomization, can be guaranteed at the very start of a discharge operation, since the subjection of the pump device to the actuating energy is effected almost at once with the defined actuating energy. It is also possible to assign the actuating device externally to the medium dispenser, the medium dispenser and the actuating device preferably being parts of a discharge or dosing device.

In a further embodiment of the invention, the energy level is attainable on a force-dependent basis. The energy level can be achieved on a solely force-dependent or on a combined path-dependent and force-dependent basis.

In a further embodiment of the invention, the control device has restraining elements, which remain positionally secured, non-positively, by static friction forces as the energy store is loaded. In a further embodiment of the invention, the non-positive connection for the restraining elements is chosen such that, once the energy level for the liberation of the actuating energy is reached, a transition from a static friction to a sliding friction is made. The counterforce applied by the restraining elements supported non-positively against a stationary functional part is chosen such that, once the energy level for liberating the actuating energy is reached, the restraining elements can no longer be supported by static friction against the stationary functional part, but instead enter into a sliding movement by which the desired motional operation is forcibly triggered.

In a further embodiment of the invention, means for influencing friction forces between the movable restraining elements and a stationary functional part are provided. According to the configuration and the purpose of use, friction coefficients or contact angles of restraining elements and/or functional parts can in various embodiments be increased or reduced. Common options are different choice of material, roughing or smoothing of the contiguous surfaces, coating and the like. A basic option is, moreover, to match angles of the contact faces of the restraining elements to the stationary functional part such that the desired transition is made from static to sliding friction. According to the design of corresponding angles or friction values, different triggering characteristics are obtainable.

In a further embodiment of the invention, the energy store is made as an at least single-turn helical spring from a plastics material and has at least one latching means integrally molded on. Through the design of the energy store as a plastics helical spring, a particularly cost-effective manufacture by the plastic injection molding method, as well as a compact design of the energy store, can be realized. The latching means molded integrally onto the helical spring ensures a particularly favorable force flow between the energy store and the control device, whereby a simple and functionally reliable design of the actuating device can be guaranteed. As the plastics materials, POM (polyoxymethylene), PC (polycarbonate), PP (polypropylene), preferably reinforced, or other technical plastics can particularly be used.

In a further embodiment of the invention, an actuating element is configured for an at least temporary exertion of a tensile force upon the helical spring. Through the utilization of a tensile force for the actuation of the medium dispenser, a particularly compact design of the energy store can be achieved. Here the energy store, in a rest state, is at least substantially untensioned and it is only upon the application of an actuating force that it is elastically deformed in order to absorb the actuating energy. In contrast to energy stores which are subjected to pressure forces, in an energy store which can be subjected to tensile forces no compression chamber has to be provided; instead, the operation for loading the energy store with actuating energy takes place through an expansion. In the rest position, the energy store therefore occupies a smaller space than in the energy-laden functional position, whereby the advantageous, compact design is obtained. Furthermore, by tailoring the energy store to tensile forces, especially in the use of creepable materials such as plastics, it is possible to prevent a relaxation in tension which accompanies a reduction in the storable energy quantity. A relaxation in tension can arise purely through the own weight of the energy store and is reinforced by components supported against the energy store. The relaxation in tension can occur, in particular, in pretensioned compression springs which are produced from creepable materials and plastically deform under continuous loads. The energy store which can be loaded for tensile force, on the other hand, is shortened in the rest position, by its own weight or supported components, at most to its block length, that is to say the windings of the helical spring enter into mechanical contact with one another. This does not however lead to a decline in its spring force, so that the actuating energy necessary for an actuation of the medium dispenser can reliably be temporarily stored in the energy store. The actuating element equipped with an energy store which can be loaded for tensile forces thus allows a particularly advantageous energy transfer from a user, via the energy store, to the medium dispenser.

In a further embodiment of the invention, the actuating element is designed for a swivelable receiving fixture on a housing and has unlocking means for activating the latching means. Through a swivelable mounting of the actuating element on a housing, an advantageous manipulation of the actuating device with one hand can be ensured. For the discharge of a medium, the user uses his thumb to take up the actuating device into the ball of the hand and, using the other fingers of the hand, exerts the actuating force by clasping the actuating device. An, in particular, integral fitting of a latching means to the actuating element serves to ensure a simple construction and reliable functioning of the actuating device.

In a further embodiment of the invention, on the helical spring there is provided at least one holding region, which can be coupled positively and/or non-positively to a medium store. This allows the medium store to be directly received without the need for an intermediate adapter, whereby a simple and cost-effective design of the actuating device is achieved. The holding region can be realized for a non-positive transmission of the actuating energy by means of friction forces, for example by a press fit between helical spring and medium store. Alternatively or in addition thereto, corresponding geometries can also be provided on the helical spring and the medium store, which geometries, by means of pressure forces and/or tensile forces, allow the actuating energy, and the actuating forces associated therewith, to be transferred. The corresponding geometries thus ensure a positive connection between helical spring and medium store.

In a further embodiment of the invention, the holding region is configured as a base section molded integrally onto a front face of the helical spring. Through a base section, a positive connection is achieved between a correspondingly shaped region of the medium reservoir and the helical spring, in which case the medium reservoir can come to bear, especially with a substantially flat reservoir bottom, on the base section of the helical spring. A transmission of the actuating energy essentially by pressure forces is thus enabled. The base section can here be configured as a continuous base plate, as a radially inward pointing, circumferential rim or as an arrangement of radially inward jutting projections.

In a further embodiment of the invention, the helical spring has a wall thickness (xd) amounting to at least 10% of a coil width (xw). A favorable relationship between an elasticity and energy take-up capability, on the one hand, and a stability of the helical spring, on the other hand, is thereby ensured.

In a further embodiment of the invention, the helical spring has an internal diameter (xi) corresponding to at least one coil width (xw). A particularly favorable relationship between a structural space occupied by the helical spring and an energy quantity which can be stored in the helical spring is thereby obtainable.

BRIEF DESCRIPTION OF THE DRAWINGS

Further advantages and features of the invention emerge from the claims and the following description of preferred illustrative embodiments of the invention, which latter is represented with reference to the drawings, in which:

DETAILED DESCRIPTION OF THE INVENTION

Figure 1:
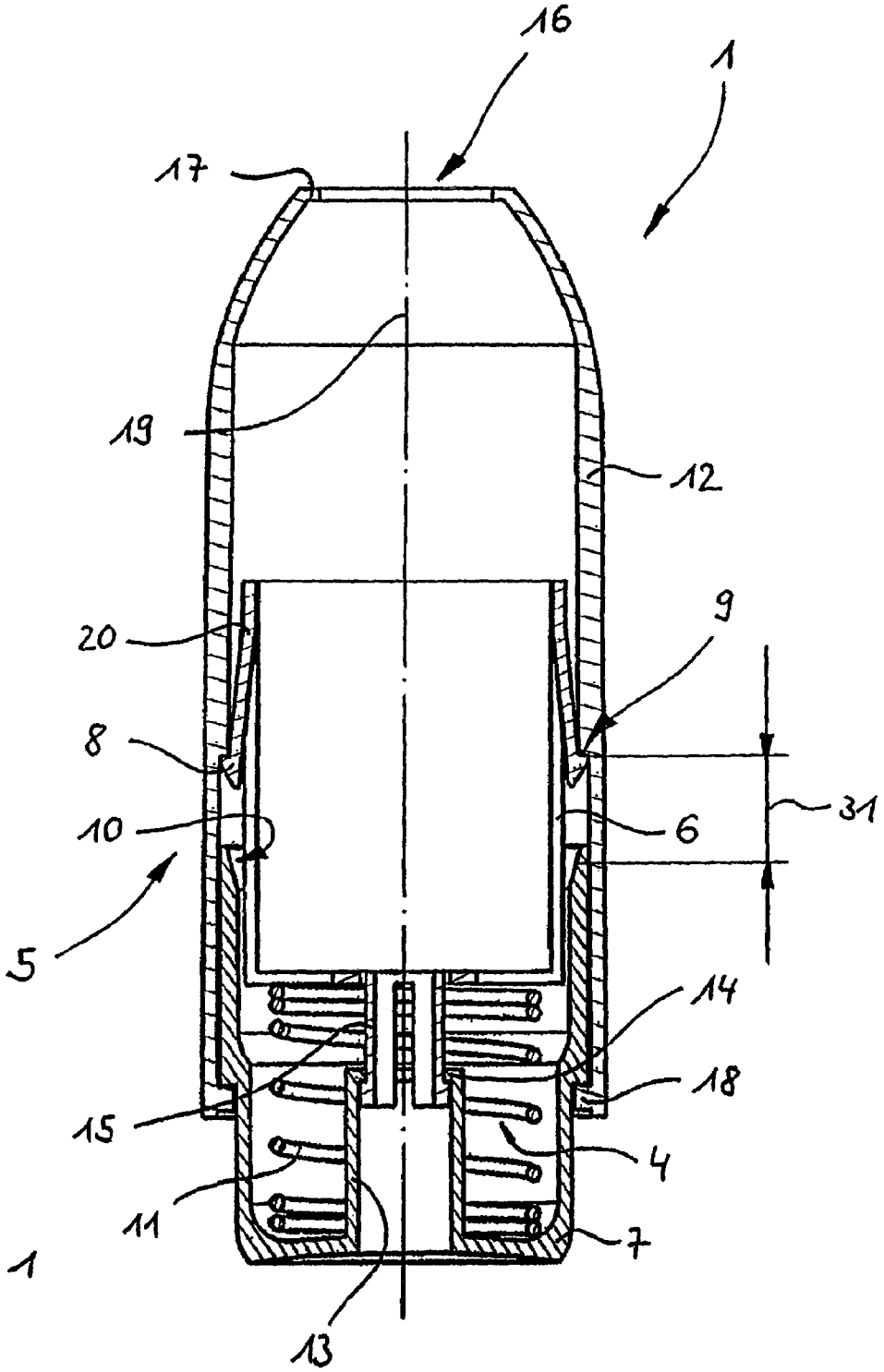
FIG. 1 shows in two-dimensional sectional representation an actuating device.

The actuating device 1 represented in FIG. 1 has an outer sleeve 12, a positioning mechanism realized as a holding device 6, an energy store 4 realized as a helical spring 11, and a trigger mechanism realized as a handle or actuating element 7. The outer sleeve 12 is substantially cylindrical in shape and has a tapered end, provided with a rounding, with an applicator receiving fixture 16. On the applicator receiving fixture 16 there is provided an inward-facing, circumferential latching collar 17, which is configured for a positive connection to an applicator of a medium dispenser represented in greater detail in FIGS. 2 to 4. At an opposite end of the outer sleeve 12, which is substantially cylindrical in shape, an inwardly directed stop collar 18 is provided, which serves as an end stop for a linear movement of the handle 7 along a center longitudinal axis 19.

The handle 7 is realized, for a positive operative connection to the stop collar 18, as a cylindrical component having two external diameter regions disposed in mutually concentric arrangement, a region of greater external diameter being received in a correspondingly realized internal diameter section of the outer sleeve 12, while a smaller external diameter section is guided by the stop collar 18 along the center longitudinal axis 19. On a front face facing the applicator receiving fixture 16, the handle 7 has a conical tapering of the wall thickness, which tapering is realized as an unlocking means 10. As part of the control device 5, the unlocking means 10, following the rapprochement of the handle 7 to latching means 8 of the holding device 6 along the actuating path 31, can cancel a positive connection of the latching means to a receiving fixture 12 and thus provoke a relative movement between holding device 6 and receiving fixture 12. The product of the actuating path 31 and the force necessary to deform the helical spring 11 produces the work to be applied by the user, which, in the form of deformation energy, is stored as actuating energy in the helical spring 11. For this purpose, the helical spring 11 is in operative connection with an inner face of the handle 7 and a bottom face of the holding device 6 and allows a transfer of force between the handle 7 and the holding device 6. The handle 7, which is mounted so as to be movable in a stroke motion within the housing-shaped receiving fixture 12, forms jointly with the receiving fixture 12 and the holding device 12 the loading means for tensioning the helical spring 11.

On the handle 7 there is provided a guide bushing 13, which is configured to guide and limit the deflection of a relative movement relative to the holding device 6. For this purpose, the guide bushing 13 has a circumferential holding collar 14, which can enter into positive operative connection with a circumferential collar of a guide pin 15 attached to the holding device 6. The holding collar 14 and the circumferential collar of the guide pin 15 prevent a pretensioning force, which can be exerted upon the handle 7 and the holding device 6 by the helical spring 11 realized as a compression spring, from possibly causing these parts to slide apart.

The holding device 6 is substantially cylindrical or beaker-shaped in design and has, on a cylinder casing, respectively oppositely disposed latching means 8, which are movable by swivel motion in the radial direction and are pretensioned in the radially outward direction and which are realized as snap hooks and are bound by means of solid joints 20 to the holding device 6. In a rest position of the holding device 6, the latching means 8 back-grip a holding geometry 9, in the shape of a circumferential collar, of the outer sleeve 12. Attached to a bottom region of the holding device 6 is the guide pin 15. Through the interaction of the outer sleeve 12, the holding device 6, the energy store 4 and the handle 7, a force flow generated by a pretensioning of the energy store 4 is closed, so that, in the rest position of the holding device 6, no movement takes place without the application of further forces. The pretensioning of the energy store can, in particular, be small or infinitesimal.

Figure 2:
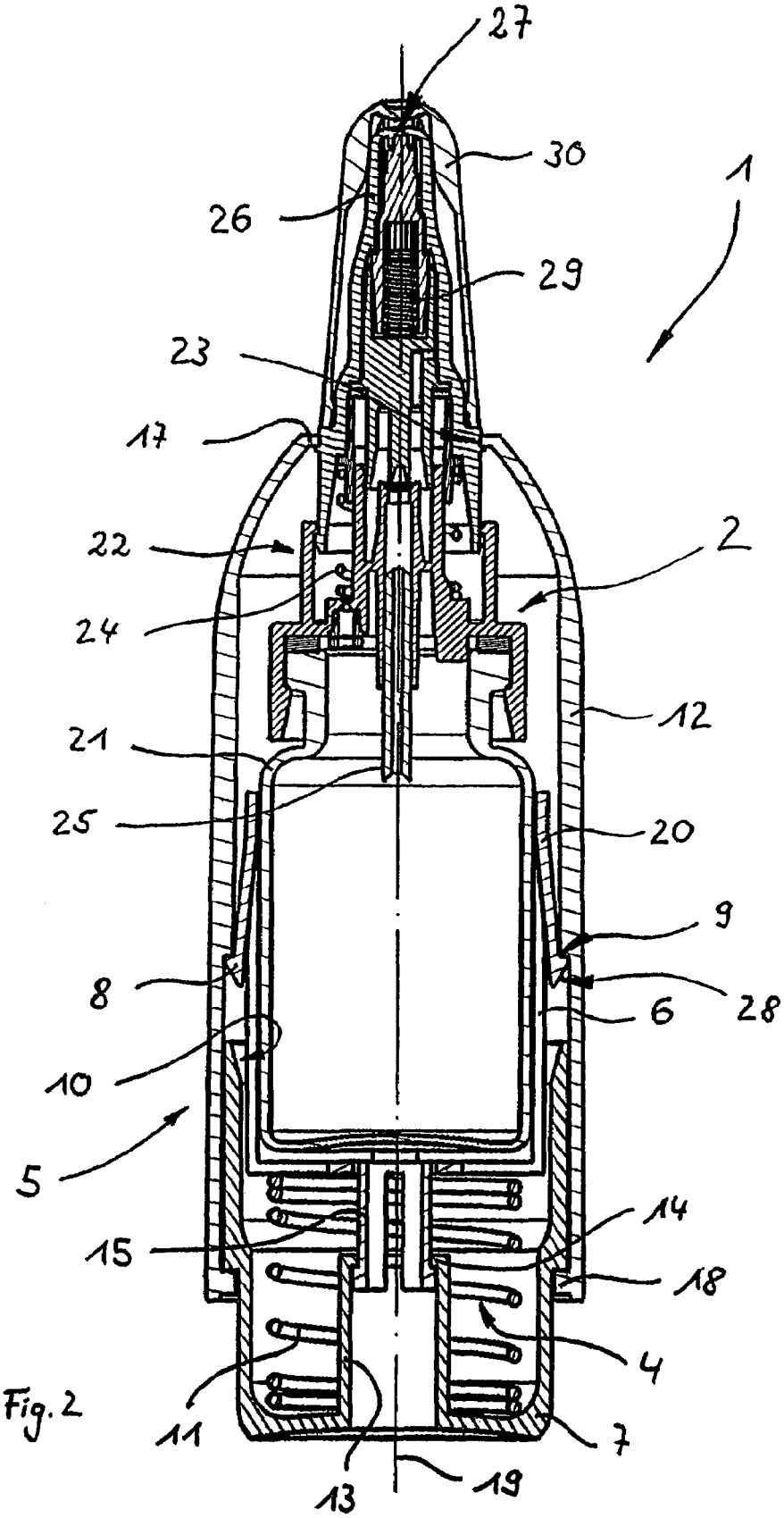
FIG. 2 shows in two-dimensional sectional representation a discharge device, having an actuating device according to FIG. 1 and a therein inserted medium dispenser in a neutral position.
Figure 3:
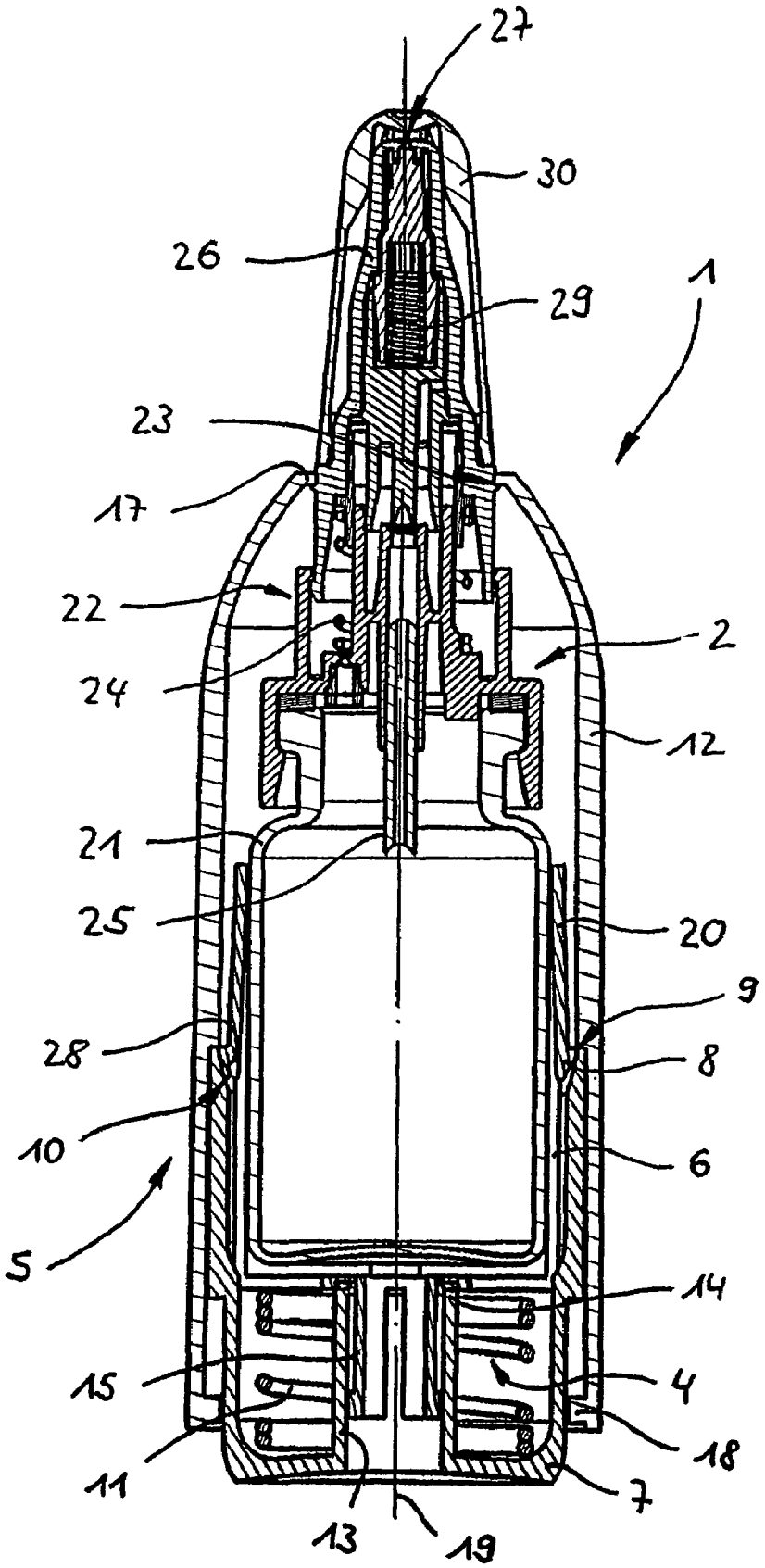
FIG. 3 shows in two-dimensional representation the discharge device according to FIG. 2, in a trigger position.
Figure 4:
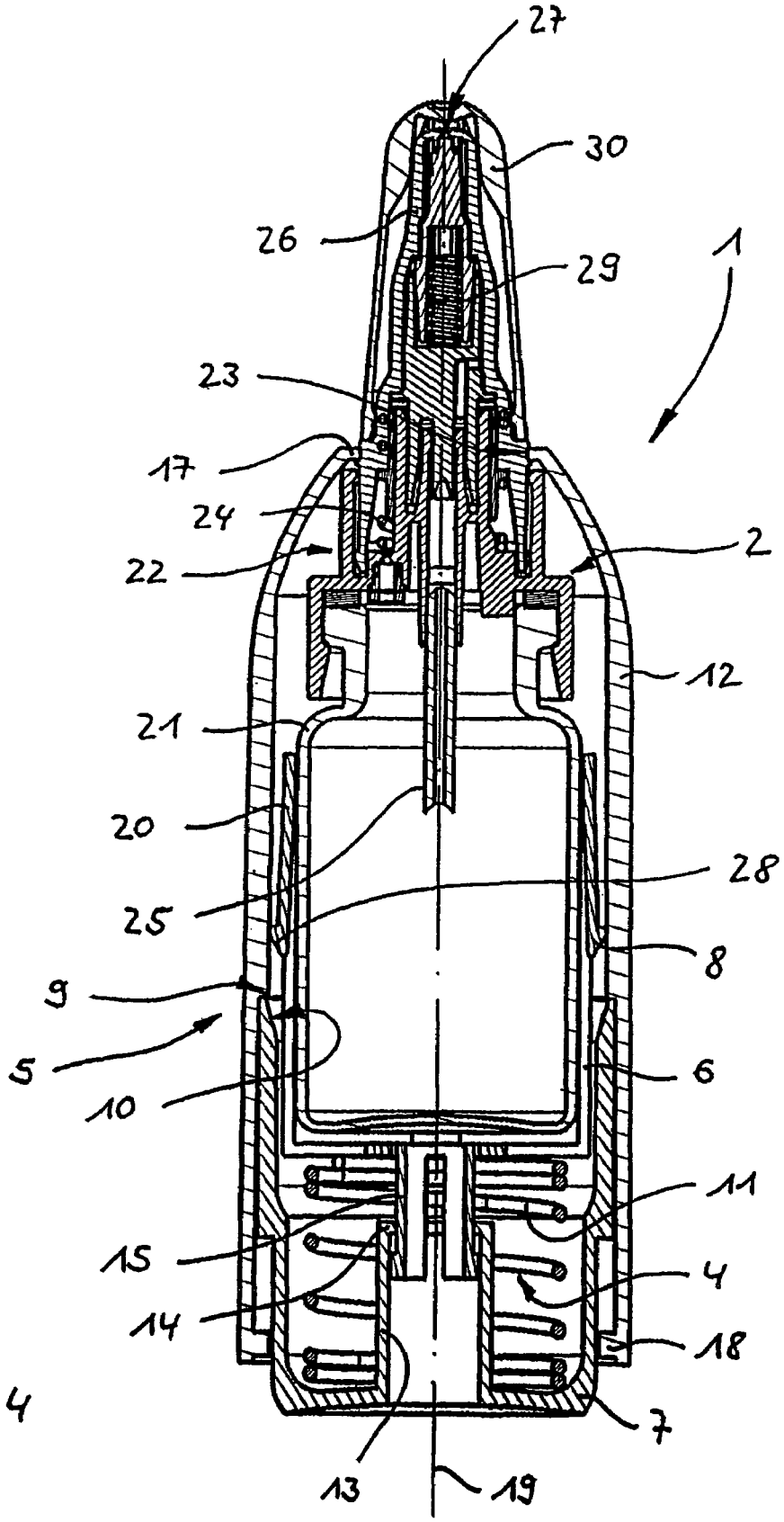
FIG. 4 shows in two-dimensional representation the discharge device according to FIGS. 2 and 3, in a discharge position.

As represented in greater detail in FIGS. 2 to 4, there can be inserted into the actuating device 1 a manually operable medium dispenser 2, which essentially consists of a medium reservoir 21 and a medium pump 22 attached thereto. The actuating device 1 and the medium dispenser 2 in this case form a discharge device. The medium reservoir 21 is realized as a substantially cylindrical hollow body having a closed and an open end. At the open end of the medium reservoir 21 there is provided a collar region, to which the medium pump 22 is positively attached, sealed with sealing means. The medium pump 22 essentially has a first pump section, which is fixedly attached to the medium reservoir 21, and a second pump section, which is attached so as to be movable relative to the first.

The medium pump 22 is adapted for use in the actuating device 1 such that it has on the second pump section, in place of a finger rest which is normally fitted there, a circumferential groove 23, which can be brought into positive connection with the latching collar 17 of the outer sleeve 12 and thus allows a transfer of force from the outer sleeve 12 to the second pump section. The medium reservoir 21 is accommodated, for the application of an actuating force, in the holding device 6, which, for its part, is operatively connected by the energy store 4 to the handle 7 and can thus be activated by the application of an actuating force. A relative movement of the second pump section relative to the composite formed from the medium reservoir 21 and the first pump section can thus be obtained, which relative movement leads to a discharge of the medium stored in the medium store.

Between the first and the second pump section of the medium pump 22 there is provided a restoring spring 24, which, in the absence of an actuating force upon the medium pump 22, safeguards the starting or neutral position, represented in FIG. 2, between the first and the second pump section. In this starting position, a pump chamber (not described in greater detail) of the medium pump 22 is communicatively connected by a riser pipe 25 to that in the medium reservoir 21 and thus enables medium to flow into the pump chamber. For an actuation of the medium pump 22, apart from friction forces and a force necessary to the pressurization and to the surmounting of the liquid friction of the medium during the discharge operation, essentially the spring force applied by the restoring spring 24 also needs to be surmounted, since the restoring spring 24 is configured as a compression spring.

At an end of the medium dispenser 2 which is facing away from the actuating device 1, and thus on the second pump section, there is provided an applicator 26 realized as an olive-shaped boss, which has a medium guide (not described in greater detail) having a pressure valve 29 and an outlet opening 27 disposed on the front face. As a result of the applicator 26 and the outlet opening 27 provided therein, the medium to be conveyed by the medium pump 22 can be discharged as a fine spray into an environment of the medium dispenser.

Since, especially when a medium dispenser of this type is used to dose out pharmaceutical substances, a discharge behavior of the medium dispenser is desired which is independent of the actuation by the user, the actuating device 1, which functions essentially independently of the deployed medium dispenser 2, enables the medium dispenser 2 to be activated in a predefinable manner and thus independently of a user-specific actuation.

While the actuating device 1, in respect of the starting position represented in FIG. 2, has only an internal force flow between the holding device 6, the energy store 4 and the handle 7, in the case of FIGS. 3 and 4 the effect of an external operating force to be applied by a user is represented. This operating force can be exerted upon the actuating device 1, for example, by virtue of the fact that the actuating device 1 is placed with the handle 7 onto a surface, after which, with the hand of the user, an actuating force is exerted upon the outer sleeve 12, which leads to a compression of the energy store 4 realized as a helical spring 11. Through the compression of the helical spring 11, which accompanies a relative movement of the handle 7 relative to the outer sleeve 12, an increase is effected in the force exerted upon the bottom of the holding device 6. Since the holding device 6 is held positively with the latching means 8 in the holding geometry 9 of the outer sleeve 12, no relative movement of the holding device 6 initially takes place. Initially, therefore, the operating force applied by the operator leads along the actuating path merely to an increase in the actuating energy stored in the energy store 4 as a result of the fed-in work.

As a result of the relative movement of the handle 7 relative to the outer sleeve 12 and the holding device 6 locked positively thereon, the unlocking means 10 draw nearer to the latching means 8, a substantially linear relationship existing between the rapprochement of the unlocking means to the latching means 8 and the actuating energy fed into the energy store 4 as a result of the design of the helical spring 11 as a linear compression spring. In a non-represented embodiment of the invention, the energy store 4 can also be realized as a progressive or degressive helical spring, so that a non-linear relationship between the actuating energy and the rapprochement between the latching means and the unlocking means can also arise.

Only once a maximum force, determined by the spring constant of the helical spring 11, the distance of the unlocking means 10 from the latching means 8 and a pretensioning of the helical spring 11 in the neutral position, is exerted by the operator upon the outer sleeve 12 or upon the handle 7, do the unlocking means 10 enter into a positive operative connection with the latching means 8. The latching means 8, conditioned by the wedge-shaped outer faces and the correspondingly conically shaped latching means 10, can hereupon be disengaged from the holding geometry 9 of the outer sleeve 12. In the event of this situation represented in greater detail in FIG. 3, the positive connection between the latching means 8 and the holding geometry 9 is removed, whereby a relative movement of the holding device 6 relative to the handle 7 and the outer sleeve is enabled. At this point, the actuating energy stored in the energy store 4 leads to force being applied to the medium reservoir 21 and the first pump section connected thereto, whereby the restoring spring 24 of the medium pump 22 is deformed.

Through the deformation of the restoring spring, a relative movement between the first pump section and the second pump section is enabled. As a result of this relative movement, the medium contained in the pump chamber (not described in greater detail) is compressed and, along the medium ducts (likewise not described in greater detail), pressed into the applicator, whence, when a minimum pressure defined by the pressure valve 29 is exceeded, it can be delivered through the discharge opening 27 into the environment. The restoring force of the restoring spring 24 is here significantly less than the compression force of the helical spring 11, so that the actuation of the medium dispenser 2 proceeds automatically, and without any further effort on the part of a user a requisite and user-independent medium discharge is effected. At the end of the medium discharge, the second pump section enters with the first pump section of the medium pump 22 into a blocking position represented in FIG. 4, so that no further relative movement between the first and the second pump section is possible. The actuating energy originally stored in the energy store 4 has essentially been transferred to the restoring spring 24 and to the discharged medium.

When the actuating device 1 is released by the operator, the energy stored in the restoring spring 24 is now used to effect, within the course of a further relative movement, a resetting of the first pump section relative to the second pump section, whereupon medium is sucked into the pump chamber (not represented), in addition to which, through the relative movement between the first and the second pump section, the medium reservoir 21 is forced in the direction of the handle 7, whereby the holding device 6 is returned to the positively locked starting position. Since, at the same time, no operating force is exerted upon the handle 7, this is displaced from the end position represented in FIG. 4 into the neutral position represented in FIG. 2. The actuating device 1 and the medium dispenser 2 thus regain in total the starting position represented in FIG. 2 and are available to the user for a further medium discharging operation.

Figure 5:
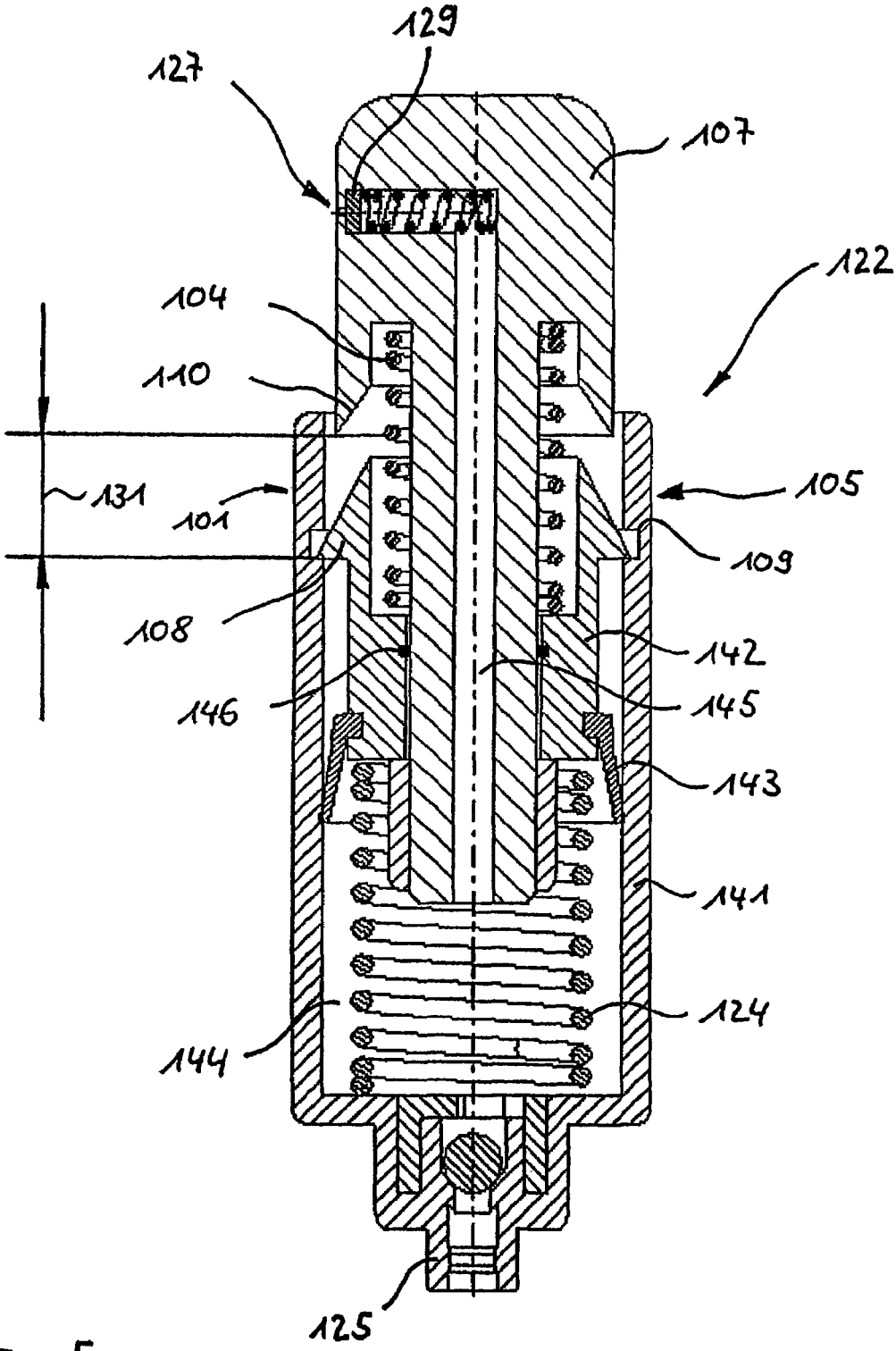
FIG. 5 shows in two-dimensional sectional representation an actuating device similar to FIG. 1 integrated in a medium dispenser, in a rest position.

In the embodiment of the invention represented in FIG. 5, the actuating device 101 is integrated in a medium pump 122 of a medium dispenser. The medium pump 122 has a handle 107 for the actuation. On the front face of the handle 107 there are provided unlocking means 110, which are realized as a conical widening of the wall of the handle 107. The handle 107 is guided in a cylindrically shaped pump sleeve 141 and is operatively connected, by means of the energy store 104 realized as a helical spring, to the positioning mechanism realized as a pump piston 142. At an end of the handle facing away from the pump piston 142, a discharge opening 127 is provided, which, in the rest position, is closed off by a spring-preloaded pressure valve 129. The discharge opening 127 is in communicative connection with a medium duct 145. The medium duct is mounted so as to be movable relative to the pump piston 142 and is sealed by an O-ring 146. The pump piston 142 has latching means 108, which, in the rest position, are positively engaged in a holding geometry 109 of the pump sleeve 141. On the pump piston 142 there is provided a gasket 143, realized as a conical ring, for limiting a pump chamber 144 formed by the pump sleeve 141. The pump piston 142 is supported by a restoring spring 124 against the bottom of the pump sleeve 141.

For the following description, in the embodiments shown respectively in a plurality of actuating states, only the respectively first figure is provided with all the reference symbols, while the respectively further figures are provided only with the relevant reference symbols, this for the sake of clarity.

Figure 6:
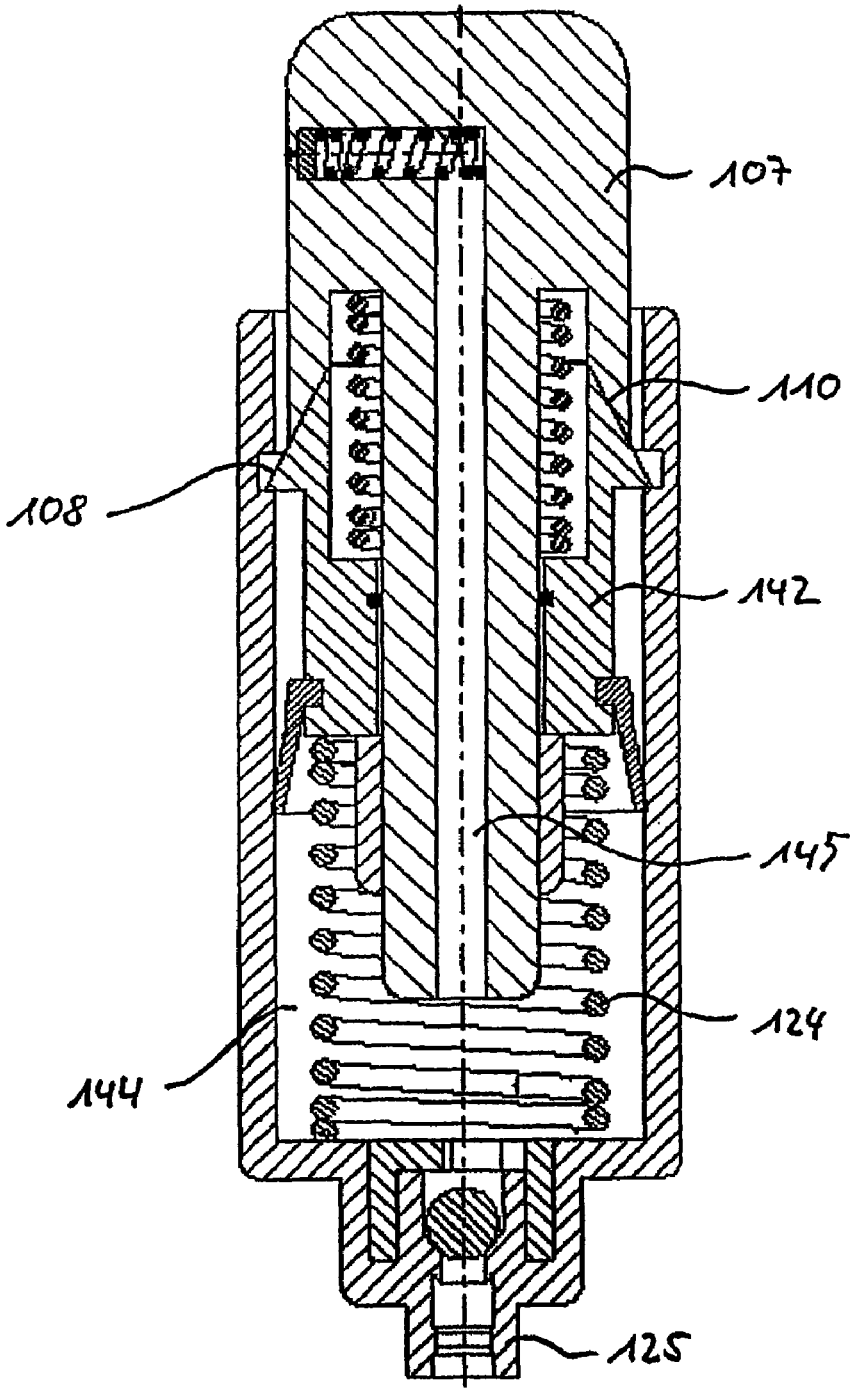
FIG. 6 shows in two-dimensional sectional representation the actuating device according to FIG. 5 integrated in a medium dispenser, in a trigger position.
Figure 7:
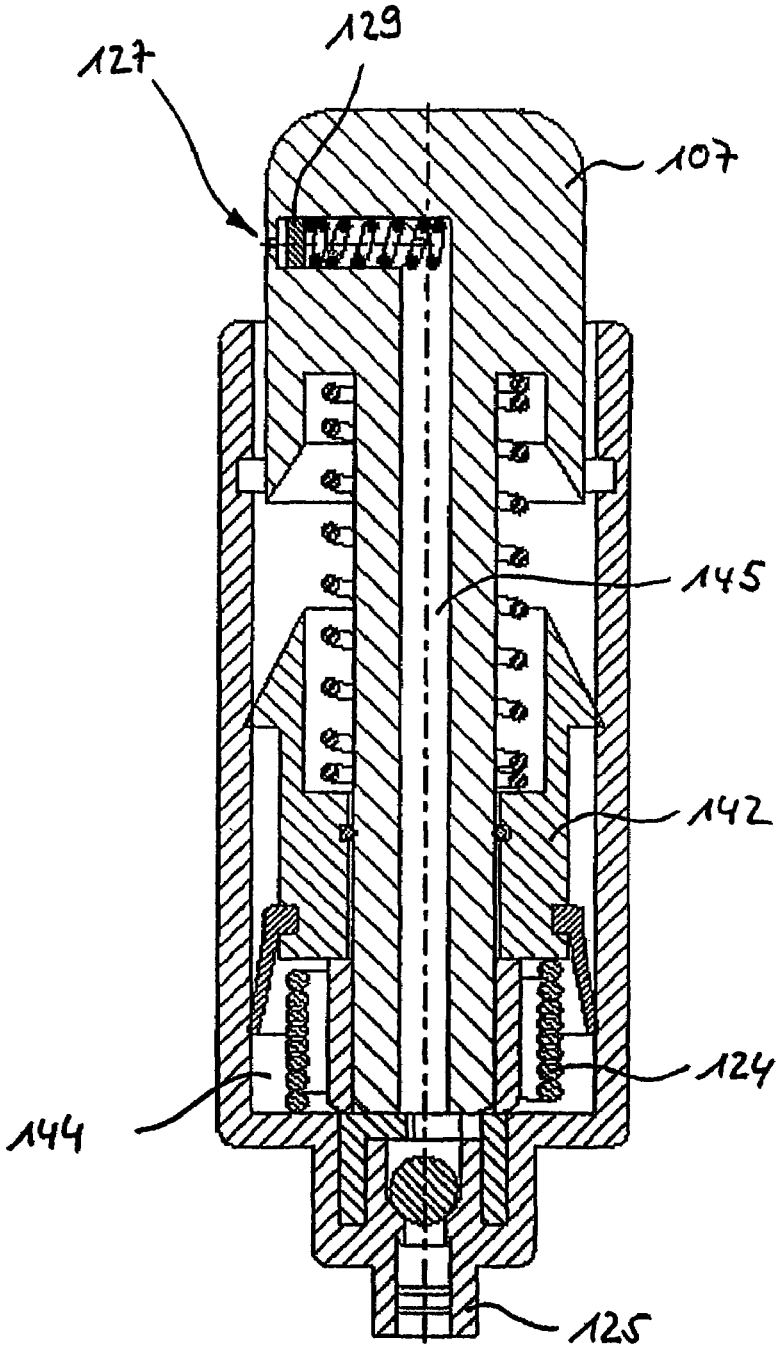
FIG. 7 shows in two-dimensional sectional representation the actuating device according to FIGS. 5 and 6 integrated in a medium dispenser, in an end position of the discharge operation.

Upon an actuation of the handle 101, a relative movement, shown in FIG. 6, between the handle 107 and the pump sleeve 141, and also the pump piston 142, initially takes place, starting from the rest position represented in FIG. 5. As a result, work is fed to the energy store 104 realized as a helical spring, which work is stored as deformation energy. No relative movement of the pump piston 142 relative to the pump chamber takes place at this point, so that the medium present in the pump chamber 144 is essentially pressureless. As a result of the relative movement of the handle 107, a rapprochement of the unlocking means 110 to the latching means 108 takes place, which, if the actuating path is adequate, as represented in greater detail in FIG. 6, enter into operative connection and lead to a removal of the positive connection between the latching means 108 and the holding geometry 109. At this point, the maximum actuating energy is contained in the energy store, which actuating energy leads, with the triggering of the pump piston 142 by the unlocking means 110, to a relative movement of the pump piston 142 relative to the pump sleeve 141 and thereby effects a sudden pressure increase in the pump chamber 144. The pressurized medium is pressed into the medium duct 145 of the handle 107, since it cannot escape in any other way from the pump chamber 144. As a result of the raised pressure of the medium, the pressure valve 129 is activated and allows the medium to escape through the discharge opening. As soon as the first energy store is in a force equilibrium with the second energy store 124 realized as a restoring spring, the discharge operation ends and the actuating device assumes the end state represented in FIG. 7. The user can now reduce the actuating force upon the handle, so that the essentially untensioned first energy store 104 can be forced by the second energy store 124, together with the pump piston 142, back into its rest position, whereupon the positive connection of the latching means 108 to the holding geometry 109 is reestablished. With the return of the pump piston 142 into the rest position, medium is sucked via the riser pipe 125 out of a medium reservoir (not represented), so that the pump chamber 144 is filled with medium for a new discharge operation and the starting position according to FIG. 5 is adopted.

Figure 8:
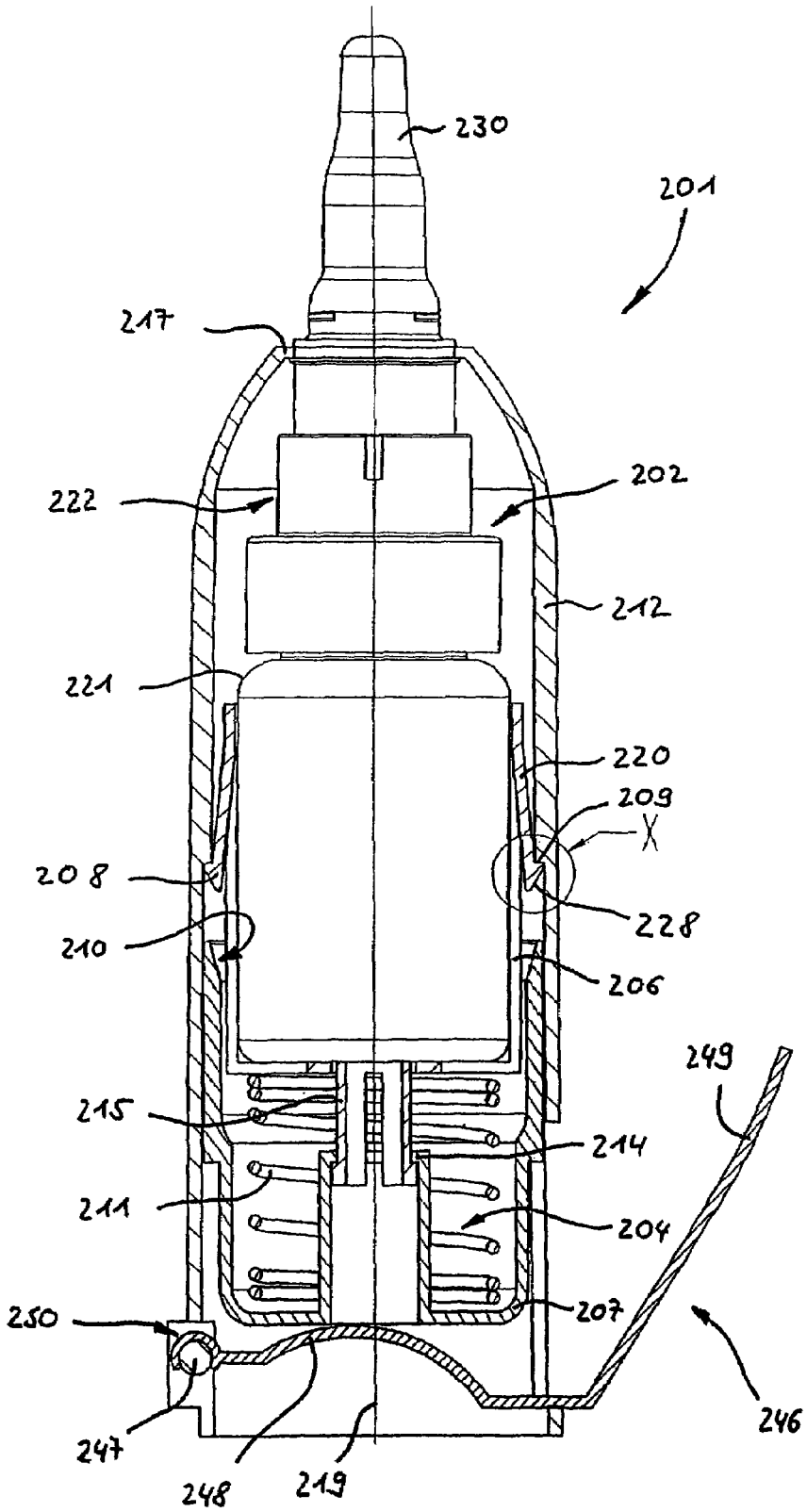
FIG. 8 shows in two-dimensional sectional representation a discharge device similar to FIGS. 2 to 4 in a rest position, having a lever gearing for activating the actuating device.

In an embodiment of the invention represented in FIG. 8, which is constructed similarly to the embodiment described in FIGS. 1 to 4, an actuation of the actuating element 207 by an actuating lever 246 takes place. The actuating lever 246 is snap-fastened, by means of a latching or clip fastening 250, on a link pin 247 connected to the outer sleeve 212 and aligned at right angles to the center longitudinal axis 219 and is thus mounted pivotably relative to the outer sleeve 212. The clip fastening 250 is adjoined by a runway 248 realized as a circular arc segment, which is designed to transfer the actuating movement transmittable to the hand lever 249 to the actuating element 207. As a result of the runway 248, which can also be designed differently from a circular arc segment shape, a low-friction transfer of the actuating movement to the actuating element 207 is able to be simply ensured.

Figure 9:
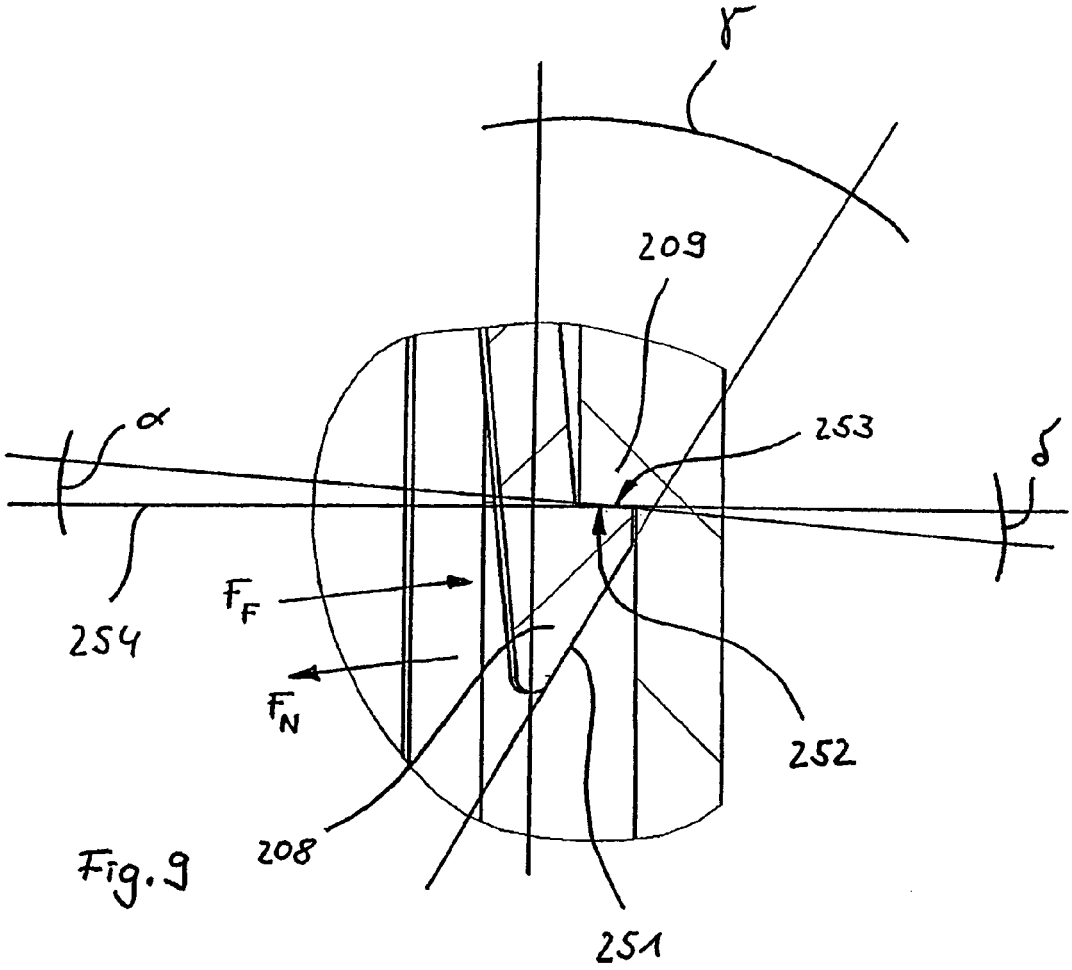
FIG. 9 shows in two-dimensional sectional representation a cutout enlargement of the latching means and of the corresponding holding geometry.

In FIG. 9, which represents a cutout enlargement of the detail X depicted in FIG. 8, restraining means 208 and the corresponding holding geometry 209 of the actuating device 201 according to FIG. 8 are represented in greater detail. A triggering behavior of the control device 205 is essentially jointly determined by the geometric design of the restraining means 208 and of the holding geometry 209. As influence variables upon the triggering behavior can be cited, in particular, the alignment of a contact face 252 of the restraining means 208 and a holding face 253 of the holding geometry 209, which faces enter into operative connection with each other. In addition, the geometric configuration of the active surface 251 facing the unlocking means 210 and of a corresponding angle $\gamma$, as well as the choice of materials, the dimensioning of the solid joints 220 and the use of solid or liquid lubricants are also of importance. In the embodiment represented in FIG. 9, the contact face 252 and the holding face 253 are aligned in such a way that, in the represented rest state, they enter into an operative static frictional connection, and an angle $\alpha$ of the latching face 252 and an angle $\delta$ of the holding face 253, relative to a radial plane 254, are identical. If the angle $\alpha$ and/or the angle $\delta$ is/are enlarged, then, when a force is transmitted into the control device 205, which force is transmitted substantially at right angles to the horizontal plane 254, a larger normal force component $F_N$ acts against the spring force $F_F$ of the elastically pretensioned solid joint 220, so that, where appropriate, a release of the restraining means can already be realized prior to a forced triggering by the unlocking means 210. In a non-represented embodiment of the invention, the unlocking means are even totally dispensed with, so that a fully force-activated triggering of the actuating energy by the control device is enabled. A triggering characteristic of the control device, substantially determined by the angles $\alpha$ and $\delta$, as well as by the elasticity properties of the solid joint 220, can be jointly determined, moreover, by sliding properties of the surfaces of the latching means 208 and of the holding means 209, which surfaces enter into operative connection with each other. For this purpose, both a slide-coating of one or both surfaces and the use of lubricants can be envisaged in order to allow a more spontaneous triggering. Alternatively, one or both surfaces can also be provided with a coating for increasing the static friction and/or sliding friction, in order to produce a more slow-acting response of the control device 205. A further parameter for the triggering characteristics of the control device 205 is the latching depth 255, which describes the extent to which the latching means 208 are covered with the holding means 209. The smaller the latching depth 255, the more spontaneous are the triggering characteristics of the control device.

Figure 10:
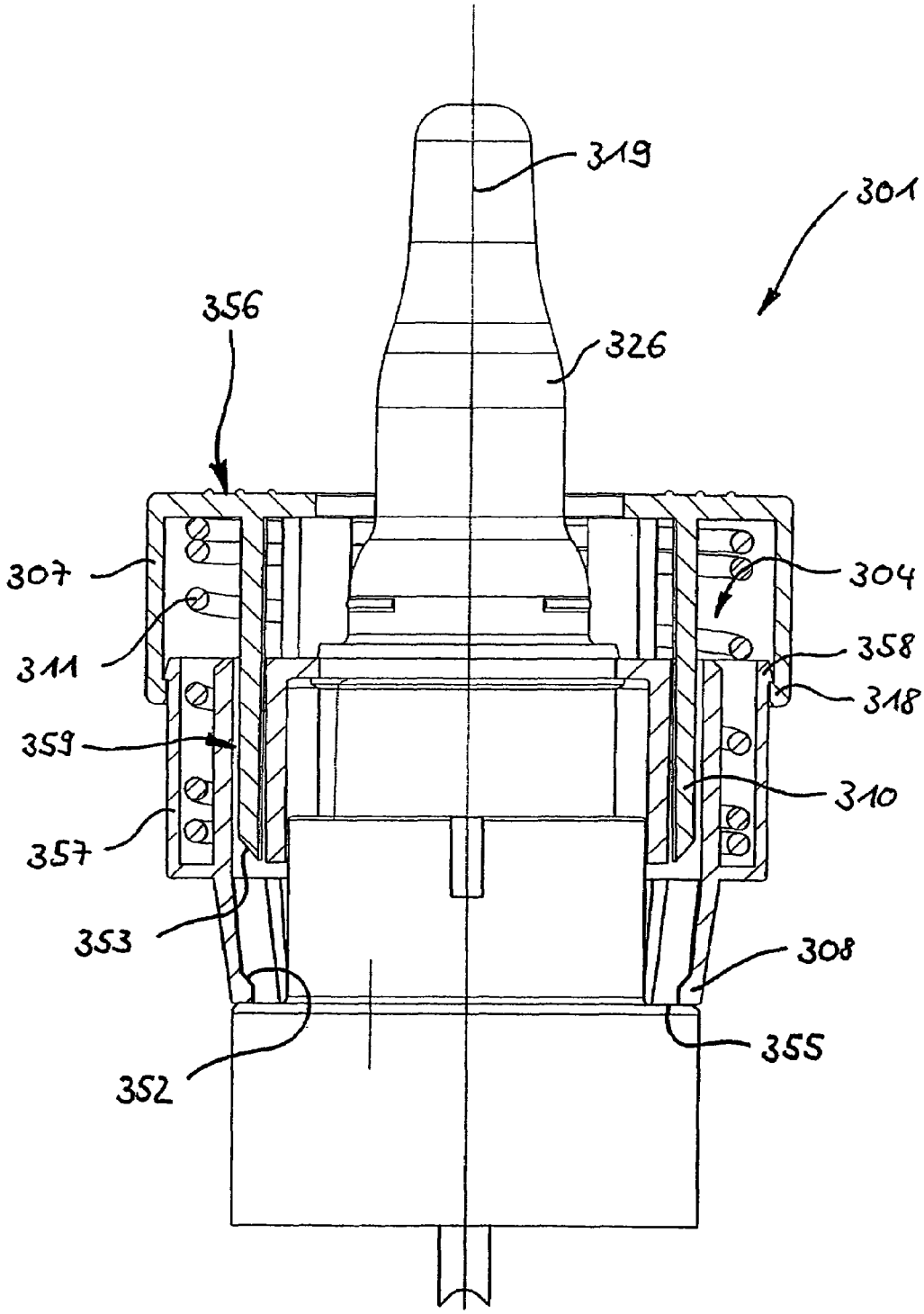
FIG. 10 shows in two-dimensional sectional representation a discharge device having an externally mounted actuating device, in a rest position.
Figure 11:
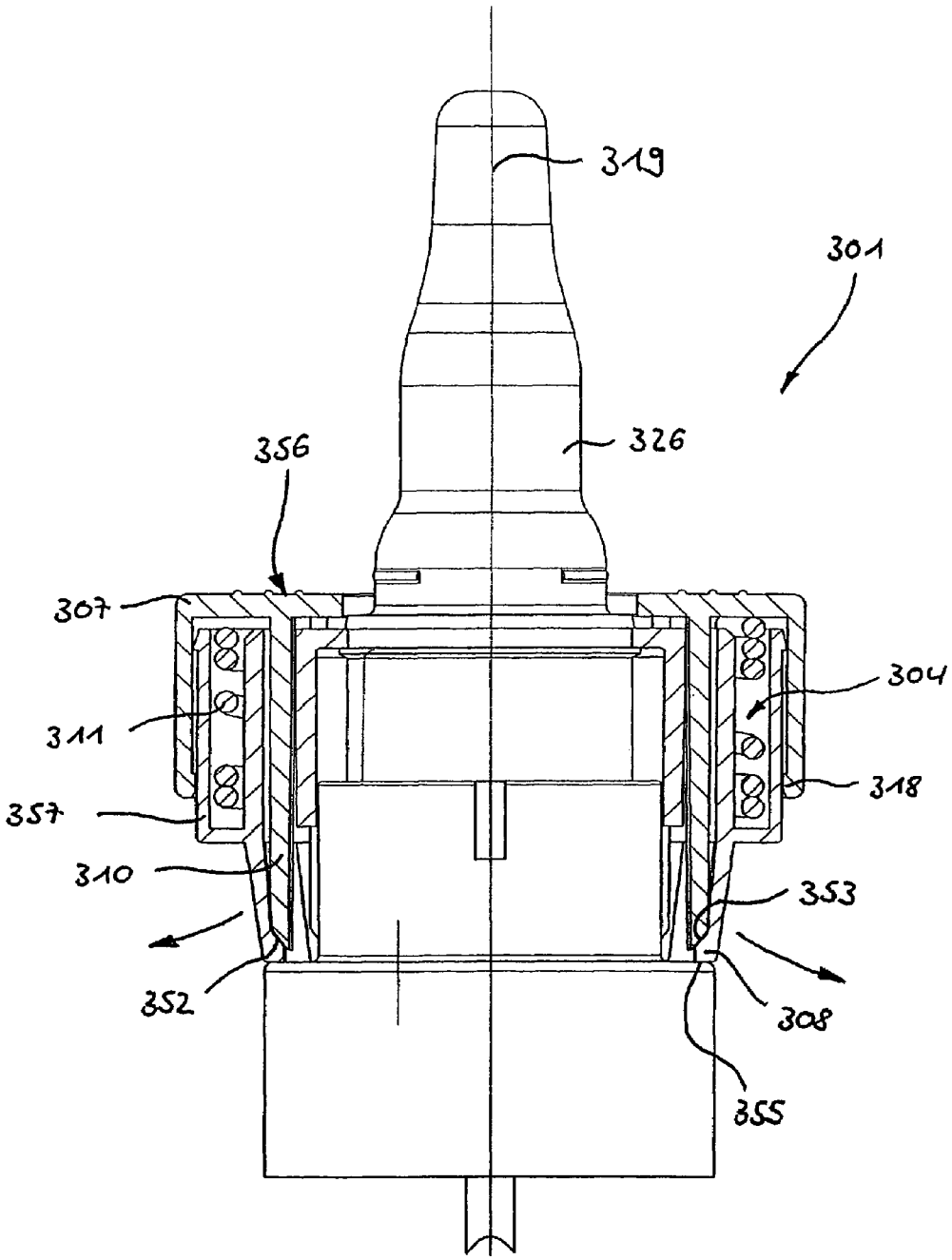
FIG. 11 shows in two-dimensional sectional representation the discharge device according to FIG. 10, in a discharge position.
Figure 12:
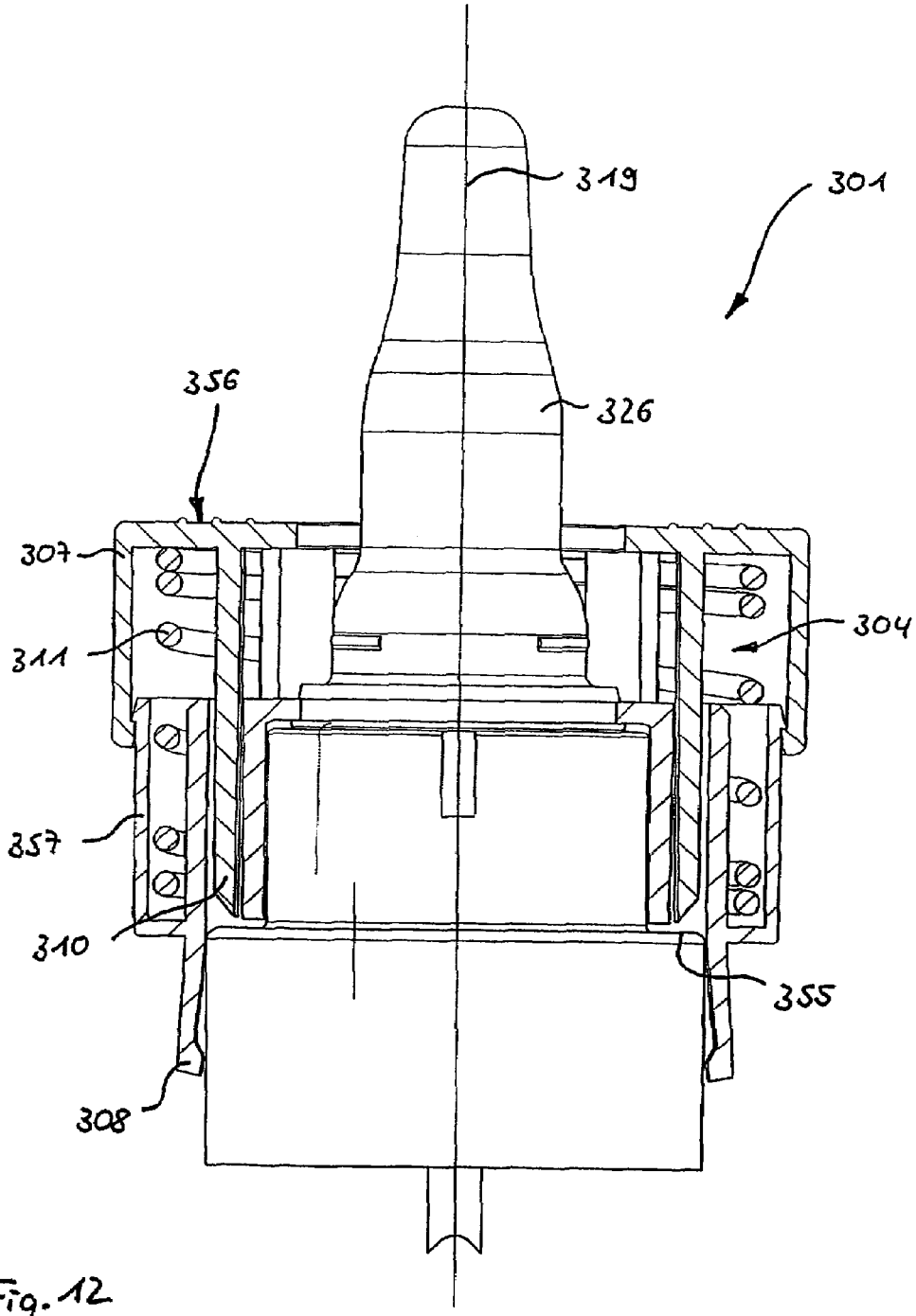
FIG. 12 shows in two-dimensional sectional representation the discharge device according to FIGS. 10 and 11, in an end position of the discharge operation.

In the embodiment of the invention represented in FIGS. 10 to 12, an actuating device 301 is placed on an applicator 326 of a discharge device, which applicator is of substantially commercially standard configuration. The actuating device 301 is realized such that it can be attached to the applicator 326, without substantial structural alterations and is operable essentially independently of the applicator 326. Only a circumferential annular shoulder 355 of the applicator 326 is used by the actuating device 301 as a force support during the loading operation of the energy store 304. The actuating device 301 has an actuating element 307, which is realized as a cylindrical handle with finger rest surface 356 and which is provided with likewise cylindrically realized unlocking means 310, integrated integrally in the actuating element 307 and arranged concentrically to the sleeve-shaped outer contour of the actuating element 307. The actuating element 307 is operatively connected to a receiving sleeve 357 realized as a holding device, a helical spring 311 being designed to store and transfer an actuating energy from the actuating element 307 to the receiving sleeve 357. In order to limit a relative movement relative to the receiving sleeve 357, the actuating element 307 has an inward-pointing, circumferential stop collar 318, which, in a rest position of the actuating device according to FIG. 10, enters into operative connection with an outwardly directed limit collar 358. Elastically attached to a front face of the receiving sleeve 357, which front face faces away from the actuating element 307, are latching means 308, which rest on the circumferential annular shoulder 355 of the applicator. The latching means 308 are realized as conically tapered circular arc segments.

For an actuation of the applicator, operatively connected to the actuating device 301, for the discharge of a medium, an operating force is exerted by a user (not represented) upon the finger rest 356 along the center longitudinal axis 319. This leads to the transmission of force to the helical spring 311, which elastically deforms and allows a relative movement between the actuating element 307 and the receiving sleeve 357 statically supported against the annular shoulder 355. The stop collar 318 here slides along a cylindrical outer face of the receiving sleeve 357, while-the unlocking means 310, which are integrally attached to the actuating element, are guided in an annular slot 359 formed by the receiving sleeve 357 and move in the direction of the latching means 308. As soon as the operator has fed a minimum energy into the helical spring 311, the unlocking means 310 can enter into operative connection with the latching means 308, as is represented in FIG. 11. As already described for the preceding illustrative embodiments of the invention, this leads to a slide-down movement of the latching faces 352 on the holding faces 353, which movement leads to a force component substantially at right angles to the center longitudinal axis 319 and thus produces an outwardly directed deflection of the latching means 308. The latching means 308 can thus no longer rest against the annular shoulder 355 of the applicator and the actuating energy stored in the helical spring 311 leads to a movement of the receiving sleeve 357. Since the receiving sleeve 357 is operatively connected by a latching collar 317 to the applicator 326, the latter is subjected to the actuating force by the movement of the receiving sleeve 357 and brings about the desired medium discharge.

Figure 13:
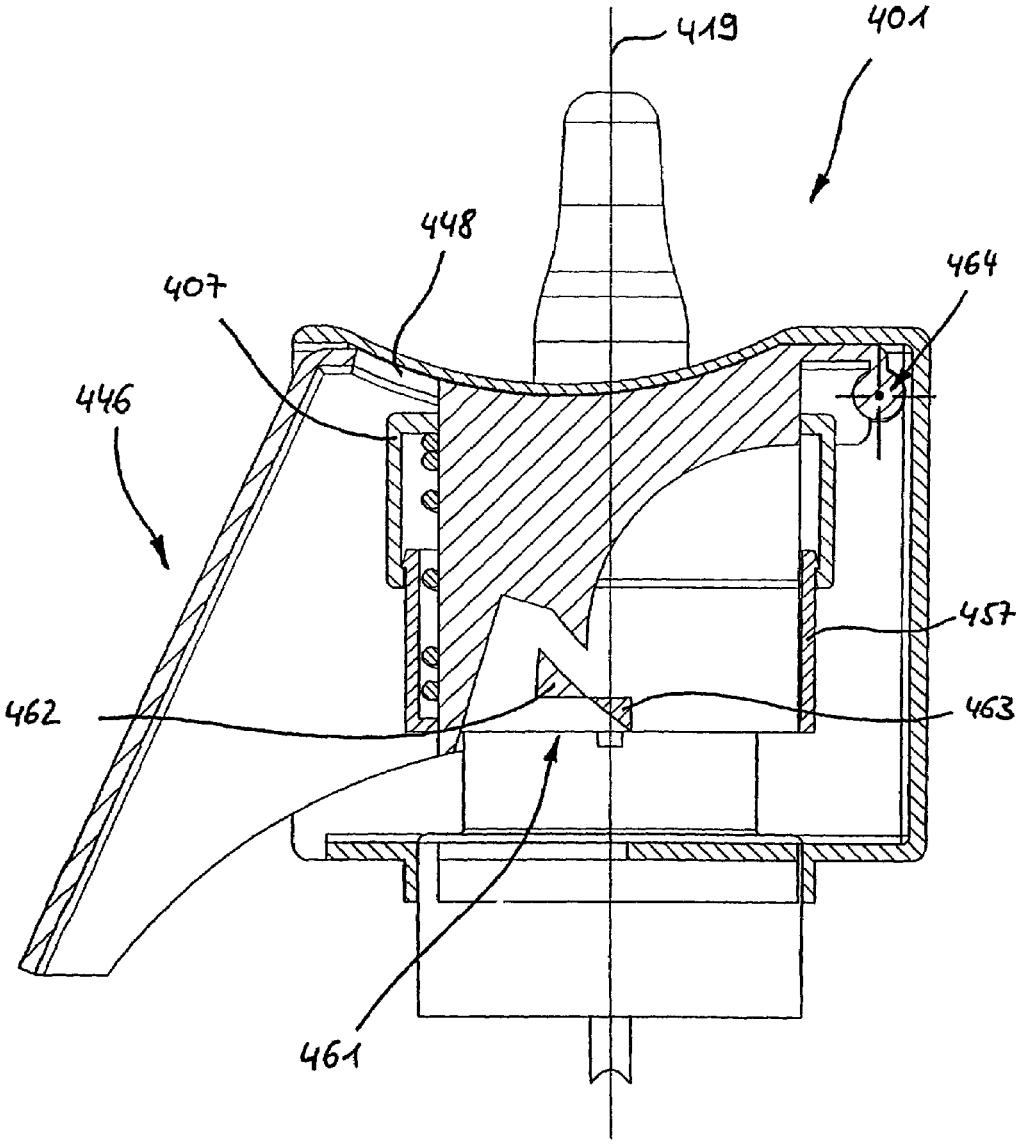
FIG. 13 shows in two-dimensional sectional representation a further embodiment of a discharge device having an externally mounted actuating device, in a rest position.
Figure 14:
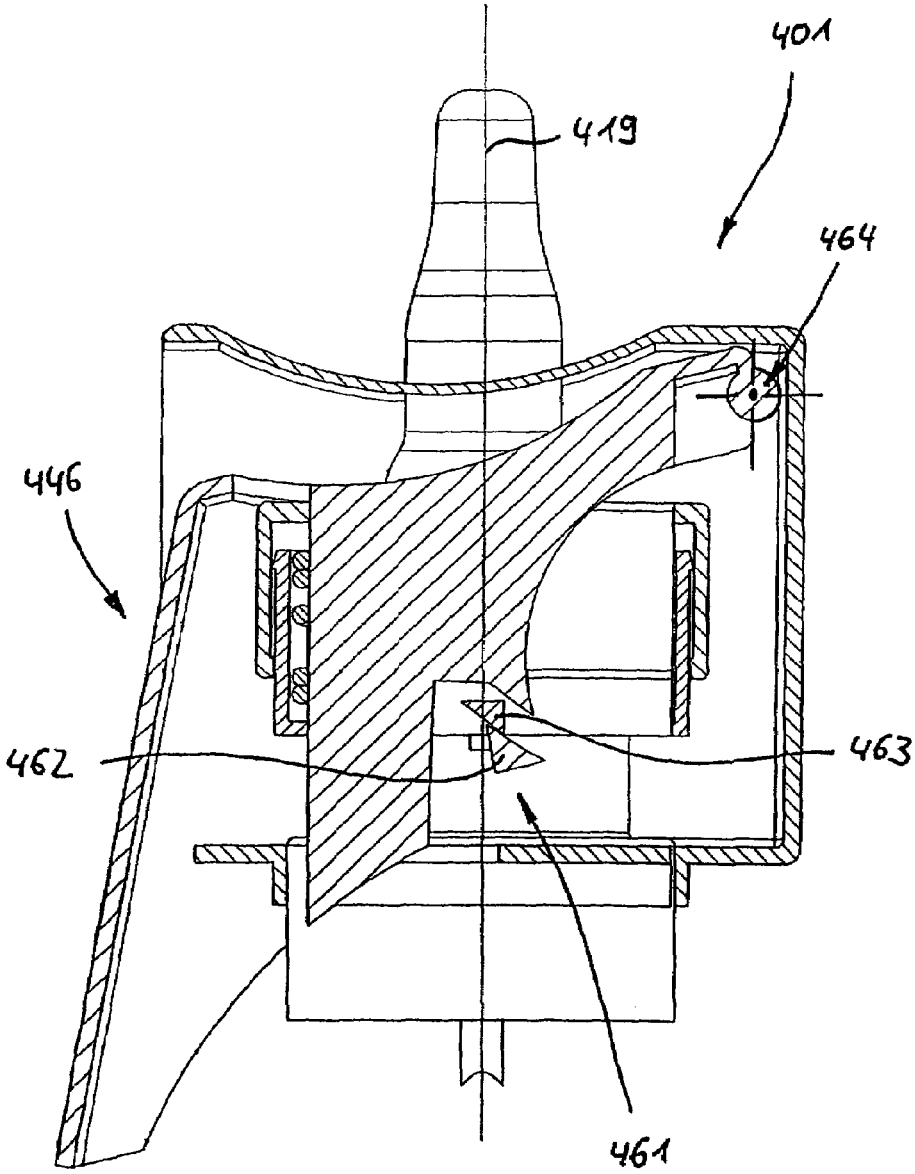
FIG. 14 shows in two-dimensional sectional representation the discharge device according to FIG. 13 in a trigger position.
Figure 15:
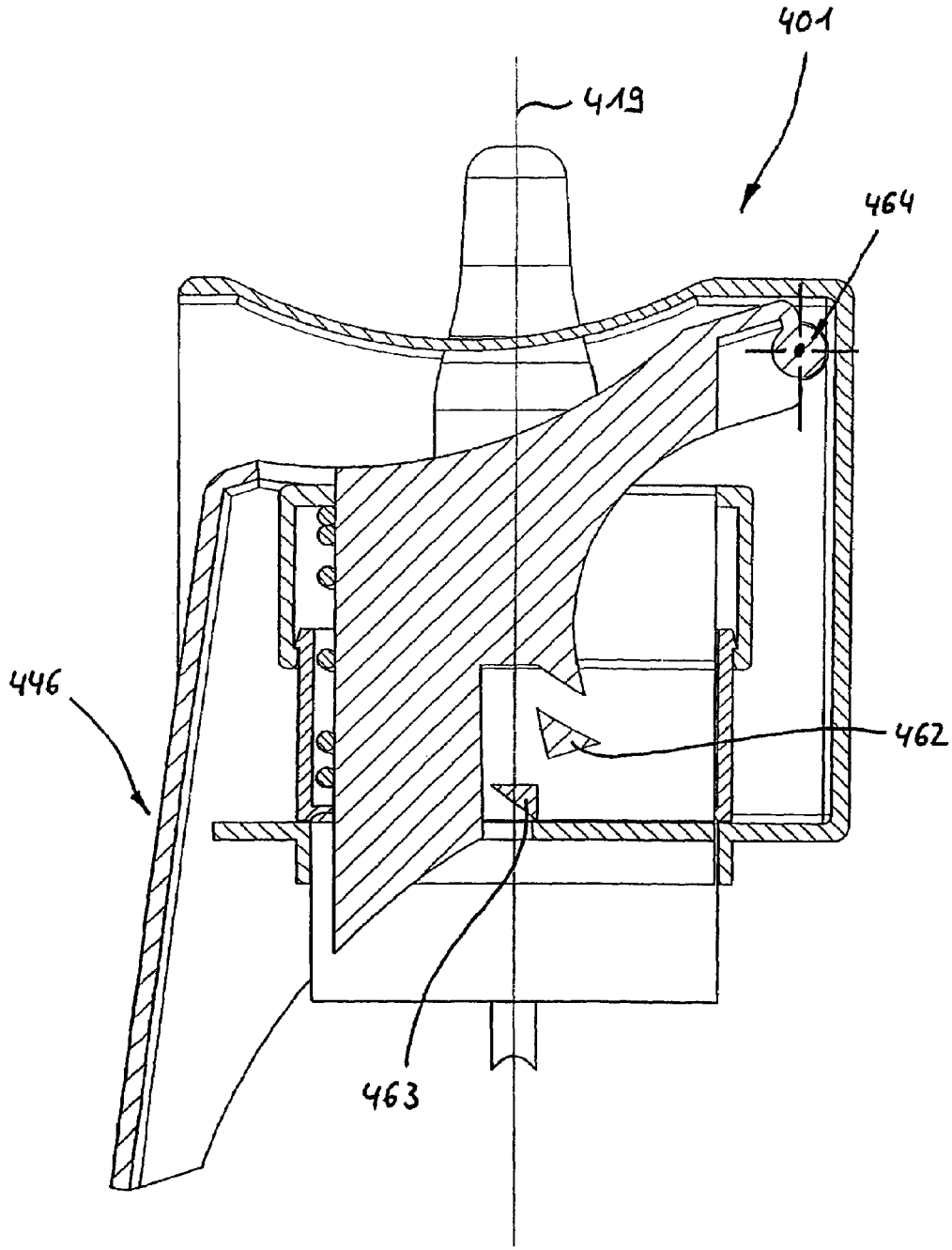
FIG. 15 shows in two-dimensional sectional representation the discharge device according to FIGS. 13 and 14, in an end position of the discharge operation.

In the embodiment of an actuating device 401 represented in FIGS. 13 to 15, which constitutes a modification of the embodiment represented in FIGS. 10 to 12, an actuating lever 446 is provided, which allows force to be transferred to the actuating element 407 via a runway 448. Unlike the embodiment of FIGS. 10 to 12, in the case of the actuating device 401 represented in FIGS. 13 to 15 no elastically fitted latching means are provided; instead, a link motion 461 having a control web 462 and a holding wedge 463 is provided. While the control web is connected to the actuating lever 446, the holding wedge 463 is attached to the receiving sleeve 457. The control web 462 has a surface, facing the holding wedge 463, having a circular-segment-shaped rounding. The radius of this rounding corresponds to the distance of the control web 462 to the fulcrum 464 of the actuating lever 446, the center of the rounding lying likewise in the fulcrum 464. An advantageous sliding-down of the control web 462 relative to the holding wedge 463 upon a movement of the actuating lever 446 is thereby ensured.

When the actuating lever 446 is actuated by a user (not represented), the control web enters, through the rotation of the actuating lever 446 about the fulcrum 464, into a positive operative connection with the holding wedge 463, as represented in greater detail in FIG. 14. The actuating energy transmitted via the actuating lever 446 into the actuating element 408 is stored in the energy store (not here represented in detail) in the same way as in the embodiment according to FIGS. 10 to 12. Since a positive connection exists between the control web 462 and the holding wedge 463, the receiving sleeve 457 provided with the holding wedge 463 cannot perform any movement. The transmitted actuating energy is therefore stored in the energy store until such time as the actuating lever is rotated to the point where, as represented in greater detail in FIGS. 14 and 15, the positive connection between control web 462 and holding wedge 463 is removed by a complete slide-down and the receiving sleeve 457 is moved relative to the medium store (not represented in detail) by the effect of the stored actuating energy, taking with it the applicator 426 and generating a discharge of medium.

Figure 16:
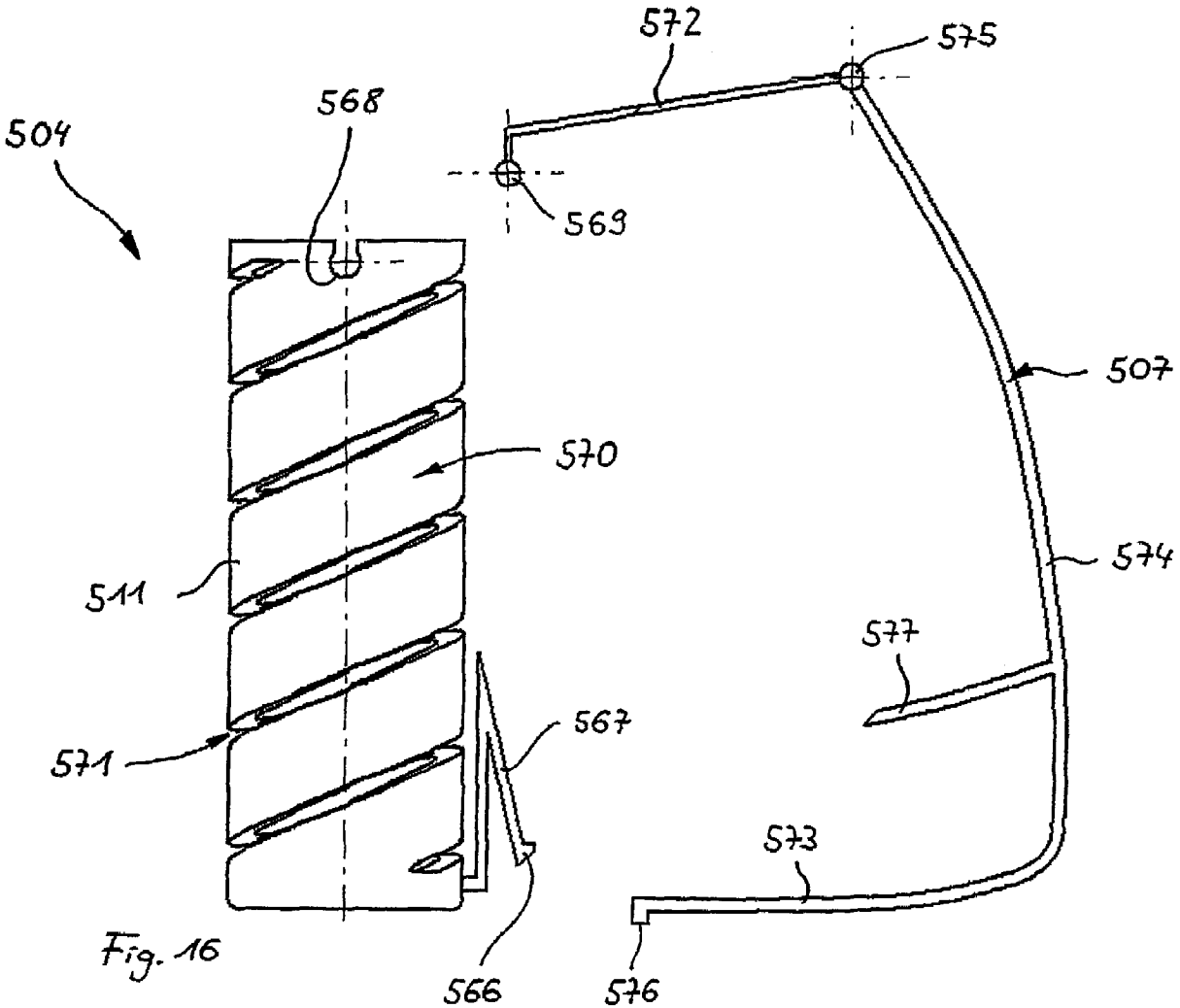
FIG. 16 shows in diagrammatic representation an energy store realized as a helical spring and an actuating element adapted thereto.

The energy store 504 represented in FIG. 16 is made as a helical spring 511 from an elastic plastics material and has a substantially tubular cross section. The helical spring 511 is configured as a tension spring and is provided in an end region with a profiled transverse groove 568, which is designed for the positive reception of a tie rod 569 of an actuating element 507. Via the tie rod 569, tensile forces can be transferred from the helical spring 511 or to the helical spring 511. In a non-represented embodiment of the invention, the helical spring is integrally connected to the actuating element by a molded-on, flexurally elastic tie rod, which is provided, in particular, with film hinges, thereby ensuring a particularly advantageous manufacture and assembly of the energy store.

Figure 17:
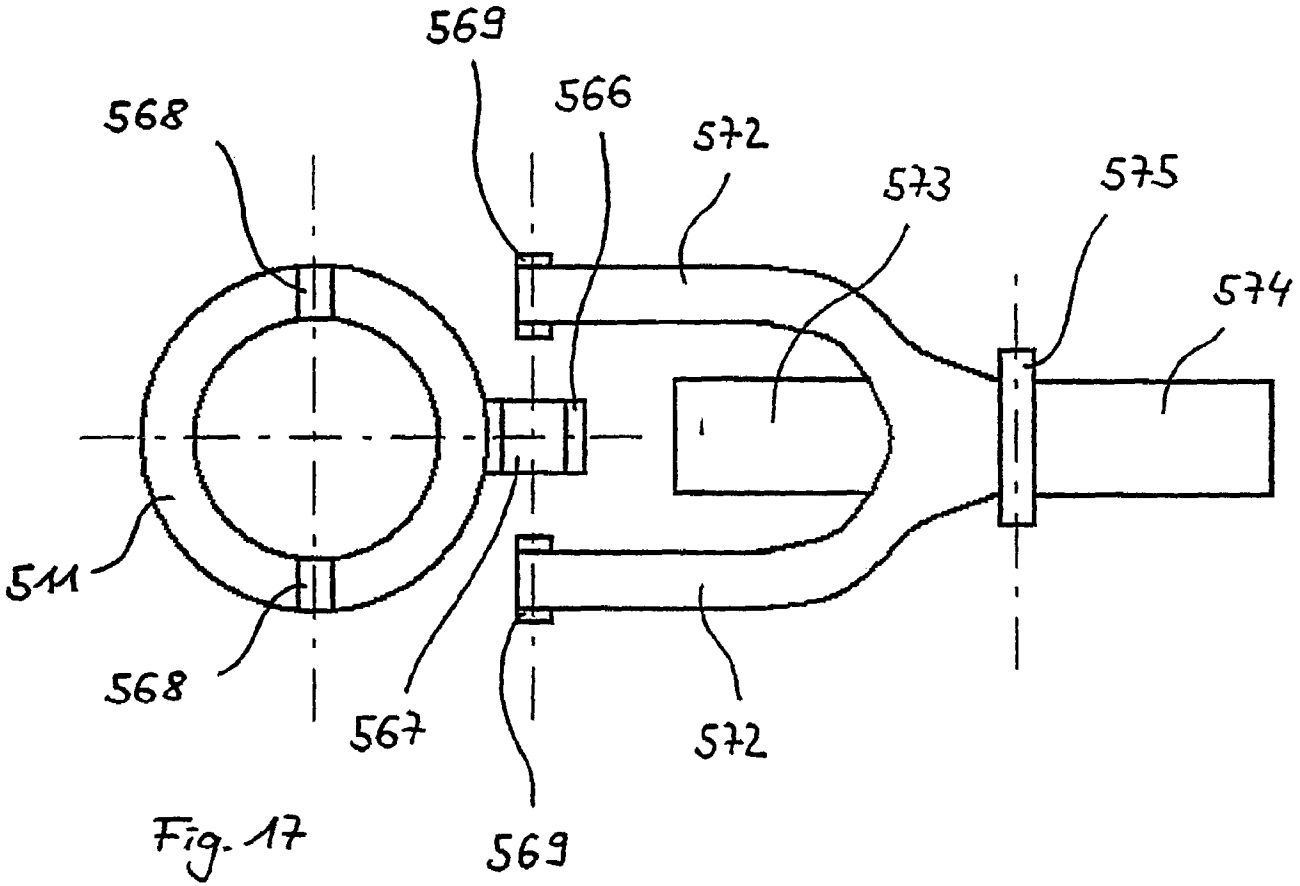
FIG. 17 shows in diagrammatic representation a top view of the energy store and the actuating element according to FIG. 16.
Figure 18:
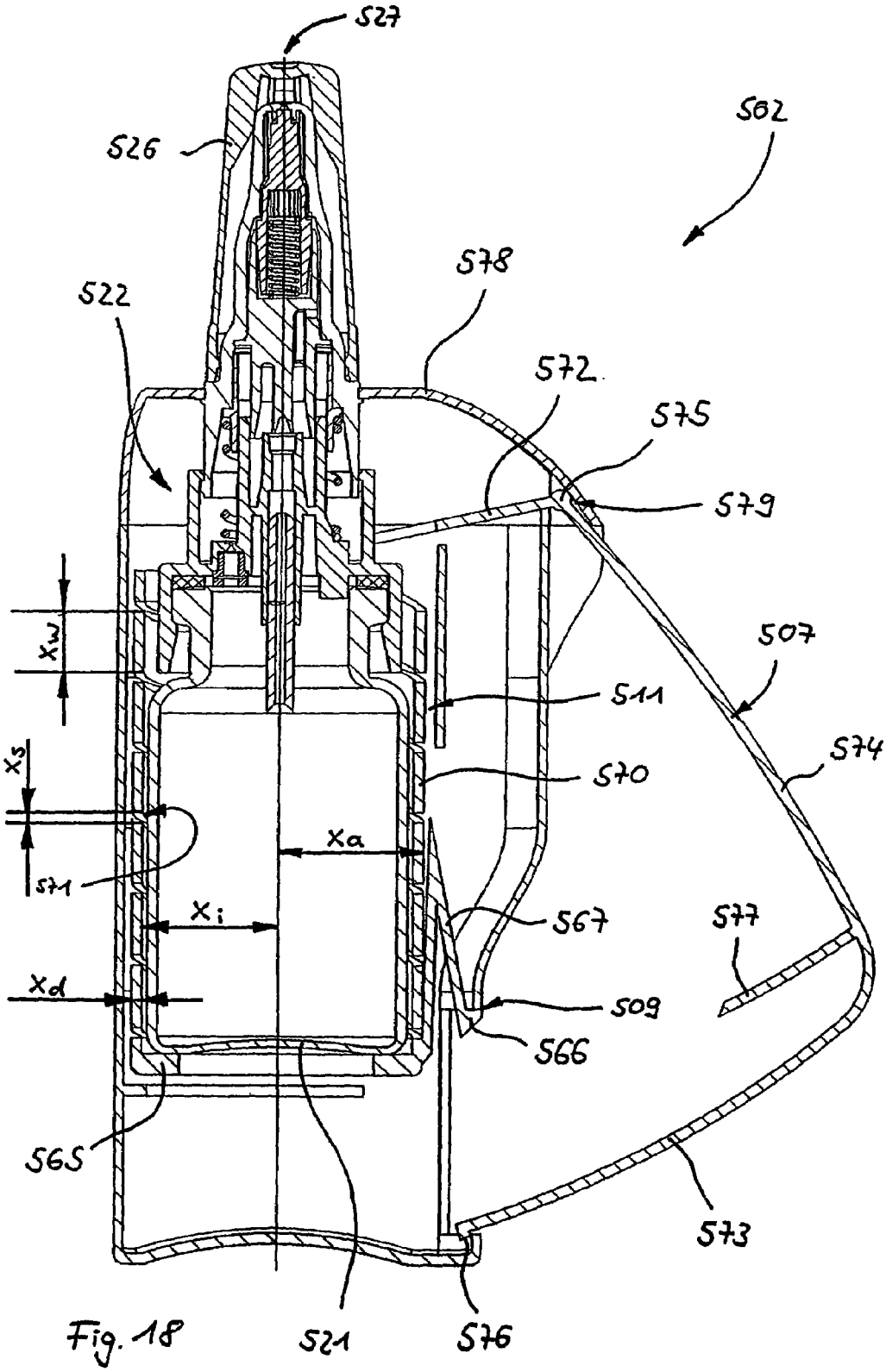
FIG. 18 shows in two-dimensional sectional representation a discharge device having a helical spring and an actuating element according to FIG. 16, in a rest position.

In the rest position according to FIGS. 16, 17 and 18, the windings of the helical spring 511 are distanced apart by a circumferential gap 571 shaped in the manner of a screw thread, a width xs of the gap 571 being substantially smaller than a width xw of the winding 570. In the present illustrative embodiment, the width of the gap xs measures about 20% of the width xw of the winding. An internal diameter of the helical spring xi measures about double the width xw of the winding. An external diameter of the helical spring xa measures about 2.2 times the width xw of the winding, so that a material thickness xd of the winding roughly corresponds to the width xs of the gap and thus to about 20% of the width xw of the winding.

While the helical spring 511 represented in FIGS. 16 to 20 is realized as a single-turn helical spring, in a non-represented embodiment of the invention a multi-turn helical spring, having a plurality of screw-thread-like gaps, can also be provided in the style of a multiple thread.

According to FIG. 16, the actuating element 507 has a substantially U-shaped cross section, a tie rod 569 being attached to the end face of the side branches 572, while the second side branch 572 is provided in an end region with a projection 576. To a base 574 of the actuating element 507 there is attached a spike 577, which is aligned substantially parallel to the side branches 572 and 573 and which is designed for an interaction with the latching boss 566 of the helical spring 511. To a transition region between base 574 and side branch 572 there is attached a pivot pin 575, which is designed for a pivotable mounting of the actuating element on a housing part of a medium dispenser. As is represented in great detail in FIG. 17, the side branches 572 emanating from the pivot pin 575 are split in a fork shape and thus allow an embracing of the medium pump, as shown in FIGS. 18 to 20.

Figure 19:
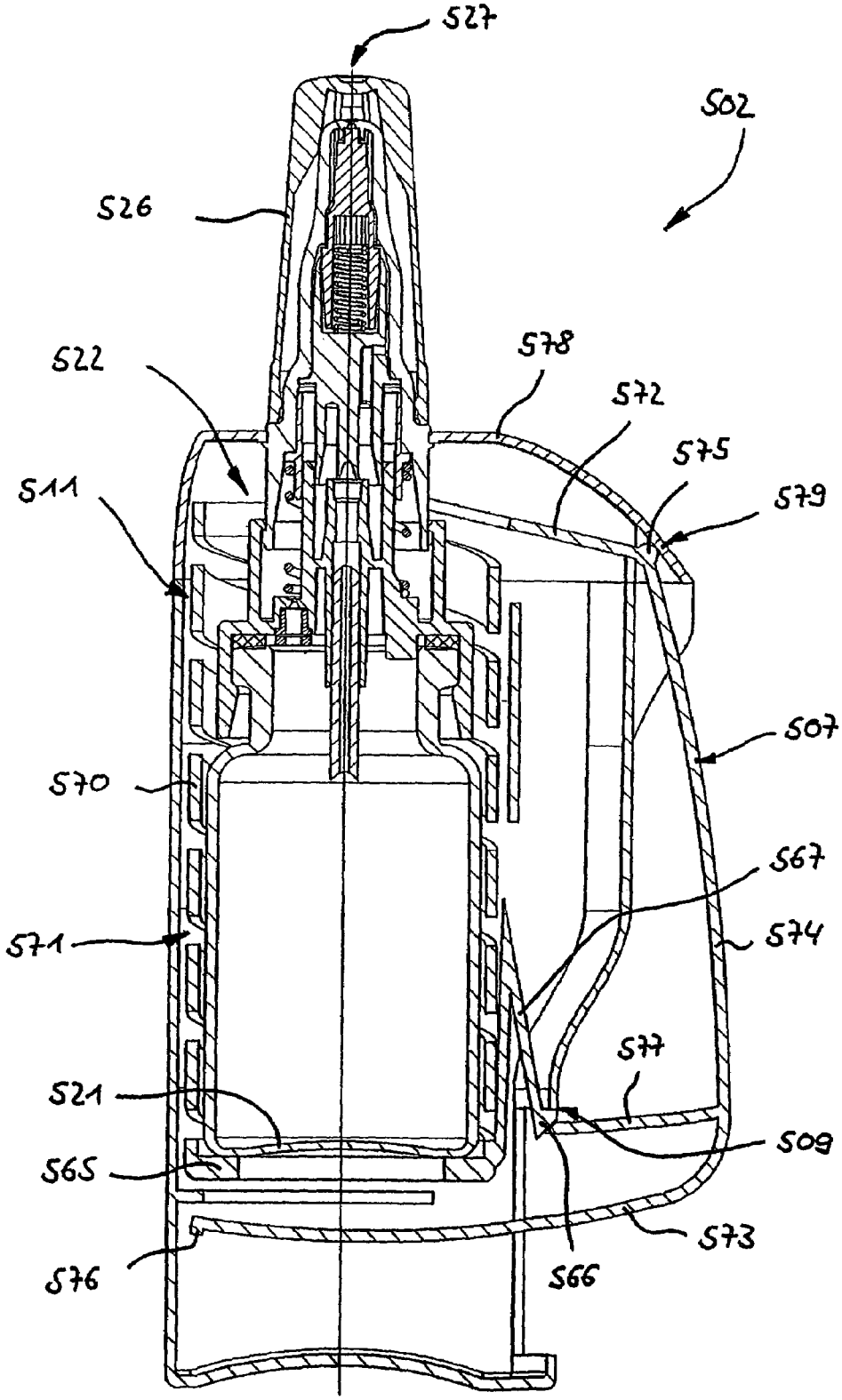
FIG. 19 shows in two-dimensional sectional representation the discharge device according to FIG. 17, in an actuating position prior to triggering of the medium discharge.
Figure 20:
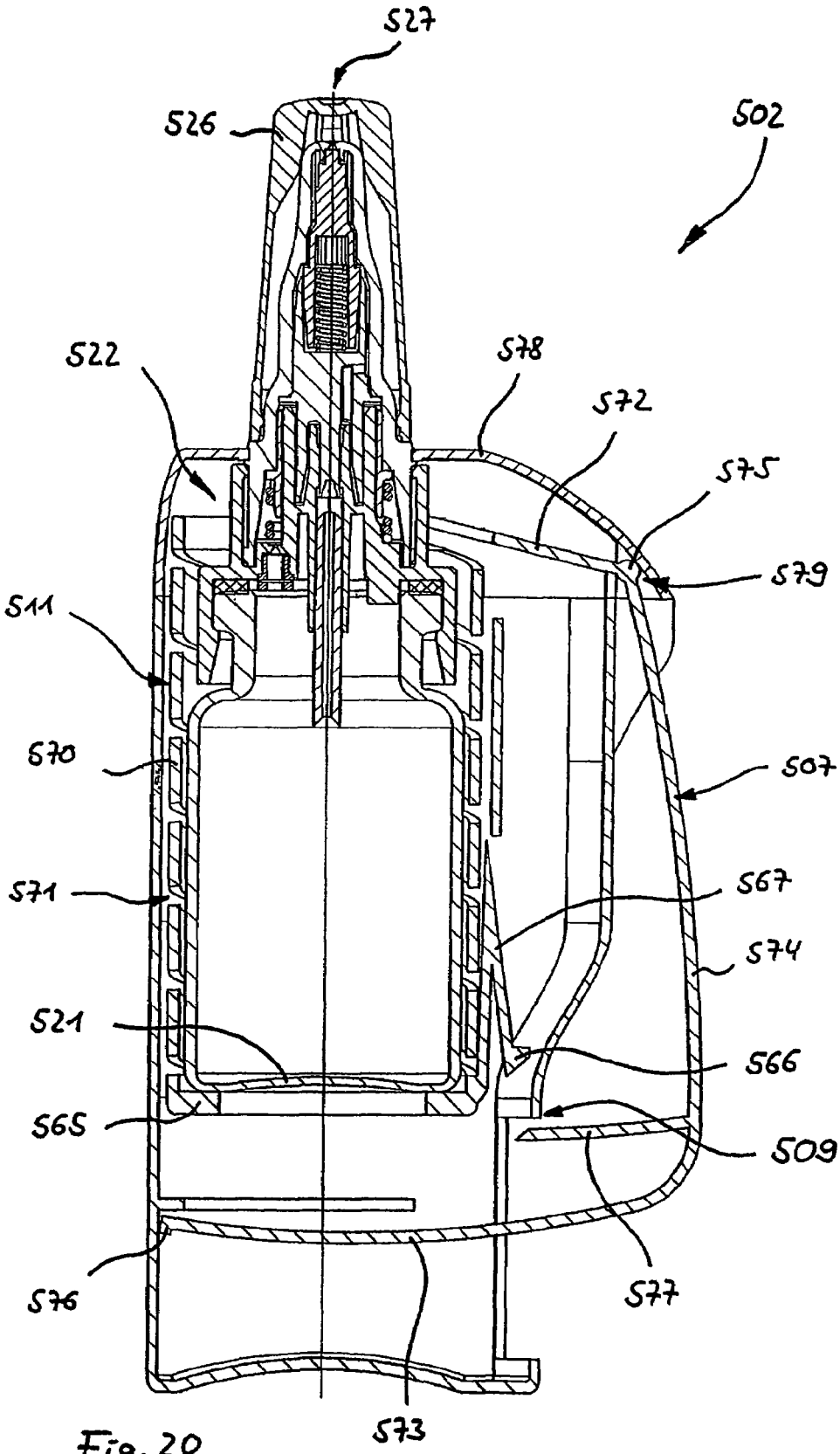
FIG. 20 shows in two-dimensional sectional representation the discharge device according to FIGS. 17 and 18, in an actuating position following triggering of the medium discharge.

At a front-face end of the helical spring 511, which end faces away from the transverse groove 568, there is provided a circumferential and radially inwardly directed ring collar 565 (not represented in detail in FIGS. 18 to 20), which constitutes an integrally molded-on base section designed for the positive reception of a medium reservoir 521 represented in FIGS. 18 to 20. A latching boss 566, mounted on a support section 567 of flexurally elastic realization, is molded integrally onto the helical spring 511 as latching means.

The medium dispenser 502 according to FIGS. 18 to 20 is equipped with the helical spring 511 and the actuating element 505 according to FIGS. 16 and 17 and has a medium pump 522 provided with a medium reservoir 521. The medium pump 522 substantially corresponds in terms of its structure to the medium pump according to FIGS. 2 to 4, for which reason reference is made to the associated description sections for details. The medium dispenser 502 is equipped with a housing 578, which encloses the medium reservoir 521 and the medium pump 522 except for the applicator 526. The actuating element 507 is accommodated on the housing 578 so as to be pivotably movable on a bearing 579 and thus enables an operating force applied to the base 574 by a user to be transferred to the helical spring 511.

In a rest position represented in FIG. 18, the latching boss 566 of the helical spring 511, realized as a latching means, is in a latching position with a holding geometry 509 of the housing 578, so that the transmission of an actuating force to the actuating element 507 leads initially only to a elongation of the helical spring 511 realized as a tension spring. The section of the helical spring 511 which is provided with the latching boss 566, and the medium reservoir 521 which is positively coupled via the ring collar 565, remain, however, initially in the rest position.

When the operating force exerted upon the base 574 of the actuating element 507 is increased, this results in an increasing elastic deformation of the helical spring 511 in the direction of the applicator 526, which is expressed as a longitudinal expansion of the helical spring 511. Since, conditioned by the substantially dimensionally stable realization of the actuating element 507, the longitudinal expansion of the helical spring 511 produces a swivel movement of the actuating element 507 about the bearing 579, the spike 577 draws nearer to the latching boss 566. As soon as a minimum elongation of the helical spring 511 is achieved, corresponding to the actuating energy necessary to discharge the medium, the spike 577 enters into an operative connection with the latching boss 566. Since a direct relationship exists between the elongation of the helical spring 511, the applied operating force and the deformation energy stored in the helical spring 511, it is ensured that the latching boss 566 can only be forced by the spike 577 out of the latching position with the housing 578 once a minimum force corresponding to the minimum elongation of the helical spring 511 is applied by the operator. This situation is represented in FIG. 19, wherein the spike 577 forces the latching boss 566 out of the latching position with the housing 578.

As soon as the spike 577 has released the positive connection of the latching boss 566 to the housing 578, the helical spring 511 can deliver the actuating energy stored by the elastic deformation, through a return deformation into the non-elongated state, to the medium pump 522, which is connected by the medium reservoir 521 to the ring collar 565 of the helical spring 511 and is supported against the housing 578.

This leads to the desired medium discharge from the outlet opening 527 of the applicator 526, which is effected at least substantially independently of the user. In order to prevent an undesirable further movement of the actuating element 507 following triggering of the latching boss 566, the second side branch 573 of the actuating device 507 is designed such that, immediately after the latching boss 566 is triggered, it runs up onto an inner wall of the housing 578 and thus prevents any further movement of the actuating element 507.

As soon as the user reduces the operating force upon the actuating element 507, the helical spring 511 is moved by its own weight and by the weight of the medium pump 522 and of the medium reservoir 521 and, where appropriate, by a restoring spring (not represented), back into the rest setting represented in FIG. 18. Upon this movement, the latching connection between the housing 578 and the latching boss 566 is also reestablished and the actuating element 507 is likewise swiveled back into the rest setting according to FIG. 18. The projection 576 limits, in operative connection with the housing 578, the swivel movement of the actuating element 507. The medium dispenser 502 is thus available for a new discharge of the medium.

In a non-represented embodiment of the invention, a cancellation of the positive connection between the latching means of the holding device and the outer sleeve is provided by means of a separate trigger mechanism, which, however, can only be triggered once the handle has been brought into a pretensioned position, so that the actuating energy necessary for the regular and proper discharge of the medium is available. In this non-represented embodiment of the invention, a time separation is therefore obtained between the feeding of the actuating energy into the energy store and the triggering of the discharge operation.

In a non-represented embodiment of the invention, the energy store realized as a helical spring is molded integrally onto the medium reservoir, whereby a particularly cost-effective actuating device is able to be realized.

The invention claimed is:

1. An actuating device for a manually operable medium dispenser, comprising:

a hollow outer sleeve, a holding device inside the hollow outer sleeve and configured for movement relative to the outer sleeve along a longitudinal axis of the outer sleeve to cause operation of the medium dispenser in response to the aforesaid relative movement, an energy store configured for storing an actuating energy necessary to actuate the medium dispenser, and a manually operative loading means configured for loading the energy store with the actuating energy in response to a manual movement of an actuating element relative to the outer sleeve, a control device provided between the outer sleeve and the holding device, the control device comprising a holding face on the outer sleeve and a contact face on the holding device, the energy store providing an initial energy to urge the holding face and contact face into engagement with one another so as to establish a static friction engagement therebetween, wherein the contact face and the holding face are inclined relative to a horizontal plane which is aligned orthogonally to the longitudinal axis, the contact face and the holding face being positionally stable with respect to one another in response to the application of the initial energy to the holding device and the static friction therebetween and as the energy store is loaded by the manual operation of the loading means, and wherein at least one of the contact face and the holding face is configured to be elastically deflectable orthogonally to the longitudinal axis, so that once a sufficient actuating energy level greater than the initial energy from the energy store is applied to the holding device, the static friction stability between the contact face and the holding face is overcome and a sliding movement of the contact face relative to the holding face will occur causing the contact face and the holding face to slidingly separate and thus liberating the actuating energy of the energy store to urge the holding device along the longitudinal axis to operate the medium dispenser.

2. The actuating device according to claim 1, wherein the energy store is designed for storage of a kinetic energy by means of elastic deformation.

* * * * *